US006368782B1

(12) United States Patent
Fukui et al.

(10) Patent No.: US 6,368,782 B1
(45) Date of Patent: Apr. 9, 2002

(54) PHOTOTHERMOGRAPHIC MATERIAL

(75) Inventors: Kouta Fukui; Masaru Takasaki; Katsuyuki Watanabe, all of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/644,531

(22) Filed: Aug. 24, 2000

(30) Foreign Application Priority Data

Aug. 24, 1999 (JP) ..... 11-236306

(51) Int. Cl.[7] ..... G03C 1/498; G03C 1/34

(52) U.S. Cl. ..... 430/619; 430/568; 430/607; 430/613; 430/614

(58) Field of Search ..... 430/619, 617, 430/568, 607, 613, 614

(56) References Cited

U.S. PATENT DOCUMENTS 5,952,167 A * 9/1999 Okada et al. ..... 430/619
5,958,668 A * 9/1999 Matsumoto et al. ..... 430/619
6,074,813 A * 6/2000 Asanuma et al. ..... 430/613

* cited by examiner

*Primary Examiner*—Thorl Chea
(74) *Attorney, Agent, or Firm*—Birch, Stewart, Kolasch & Birch, LLP

(57) ABSTRACT

A photothermographic material comprising, on one side of a support, at least one kind of photosensitive silver halide, a light insensitive silver salt of an organic acid, a reducing agent for silver ions and a binder, wherein the photosensitive silver halide has a mean grain size of 0.001 $\mu$m to 0.06 $\mu$m and the material comprises at least two kinds of organic polyhalogenated compounds at least one of which is an organic polyhalogenated compound represented by the following formula (1):

Formula (1)

wherein $Z_1$ and $Z_2$ independently represent a halogen atom, $X_1$ represents a hydrogen atom or an electron withdrawing group, $Y_1$ represents —CO— group or —$SO_2$— group, Q represents an arylene group or a divalent heterocyclic group, L represents a bridging group, $W_1$ and $W_2$ independently represent a hydrogen atom, an alkyl group, an aryl group or a heterocyclic group, and n represents 0 or 1.

15 Claims, No Drawings

PHOTOTHERMOGRAPHIC MATERIAL

FIELD OF THE INVENTION

The present invention relates to a photothermographic material.

BACKGROUND OF THE INVENTION

In recent years, reduction of amount of waste processing solutions is strongly desired in the medical diagnosis field and the photographic art field from the standpoints of environmental protection and space savings. Techniques relating to photothermographic materials for use in medical diagnosis and photographic-art processes are required which enables efficient exposure by a laser image setter or a laser imager and formation of a clear black image having high resolution and sharpness. The photothermographic materials can provide users with a simple and non-polluting heat development processing system that eliminates the use of solution-type processing chemicals including a developing solution.

The same applies to the field of ordinary image-forming materials. However, photo-images for medical use require high quality excellent in sharpness and graininess as they need very fine images. In addition, for easy diagnosis, cold monochromatic images are preferred. At present, various types of hard copy systems using pigment and dye, for example, ink jet printers and electrophotographic systems are available as ordinary imaging systems. However, no satisfactory image-forming system is available for medical use.

Methods utilizing a silver salt of an organic acid for forming an image by heat development are described, for example, in U.S. Pat. Nos. 3,152,904 and 3,457,075 and B. Shely, Imaging Processes and Materials, "Thermally Processed Silver Systems", Neblette, 8th ed., compiled by J. Sturge, V. Walworth and A. Shepp, Chapter 9, p.279, (1989). The photothermographic material, in particular, comprises a image-forming layer (photosensitive layer) containing a photocatalyst (e.g., silver halide) in a catalytically active amount, a reducing agent, a reducible silver salt (e.g., silver salt of an organic acid), and optionally a toning agent for controlling tone of silver, which are usually dispersed in a binder matrix. When the photothermographic material is heated at a high temperature (e.g., 80° C. or higher) after light exposure, a monochromatic black silver image is produced through an oxidation-reduction reaction between the silver halide or the reducible silver salt (which functions as an oxidizing agent) and the reducing agent. The oxidation-reduction reaction is accelerated by catalytic action of a latent image of silver halide generated upon exposure. Therefore, the monochromatic silver images are formed in exposed areas of the materials. This technique is disclosed in many references including U.S. Pat. No. 2,910,377 and Japanese Patent Publication (Kokoku, hereinafter referred to as JP-B) 43-4924. The photothermographic systems using a silver salt of an organic acid can achieve image quality and tones that satisfy the needs in the medical filed.

In the aforementioned photothermographic systems utilizing a silver salt of an organic acid, it has been found that a smaller silver halide grain size provides higher sensitivity due to the increase of starting points of development. However, when a smaller grain size is chosen, a problem arises in that sensitivity is significantly reduced after storage of a photothermographic material at an elevated temperature (e.g., for 7 hours at 60° C.).

SUMMARY OF THE INVENTION

An object of the present invention is to provide a means to solve those problems of the related art. More specifically, the object of the present invention is to provide a photothermographic material for use in medical imaging, photomechanical process and so forth, which has high sensitivity and superior storability before development (especially, storability at elevated temperatures).

The inventors of the present invention conducted intensive studies to achieve the aforementioned object, and as a result, they achieved the present invention.

The present invention provides a photothermographic material comprising, on one side of a support, at least one photosensitive silver halide, a non-photosensitive silver salt of an organic acid, a reducing agent for silver ions, and a binder, wherein the photosensitive silver halide has an average grain size of from 0.001 $\mu$m to 0.06 $\mu$m and the material comprises at least two kinds of organic polyhalogenated compounds wherein at least one of said organic polyhalogenated compounds is represented by the following formula (1):

Formula (1)

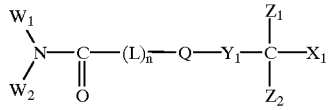

wherein $Z_1$ and $Z_2$ independently represent a halogen atom, $X_1$ represents a hydrogen atom or an electron withdrawing group, $Y_1$ represents —CO— group or —$SO_2$— group, Q represents an arylene group or a divalent heterocyclic group, L represents a linking group, $W_1$ and $W_2$ independently represent a hydrogen atom, an alkyl group, an aryl group, or a heterocyclic group, and n represents 0 or 1.

According to a preferred embodiment of the present invention, there is provided the aforementioned photothermographic material, wherein a layer containing the organic polyhalogenated compound represented by the formula (1) is formed by using an aqueous coating solution and the organic polyhalogenated compound represented by the formula (1) is added to the aqueous coating solution as an aqueous dispersion.

According to the present invention, photothermographic materials can be provided which have high sensitivity and high image quality, as well as superior storage stability before development, for example, extremely small decrease in sensitivity during storage at an elevated temperature. Therefore, the photothermographic materials of the present invention are useful for use in medical imaging, photomechanical process and so forth.

PREFERRED EMBODIMENT OF THE INVENTION

The photothermographic material of the present invention comprises at least two kinds of organic polyhalogenated compounds, and at least one of said compounds is an organic polyhalogenated compound represented by the formula (1). As organic polyhalogenated compounds other than the aforementioned compounds, an organic polyhalogenated compound represented by the following formula (II) is preferred.

Formula (II)

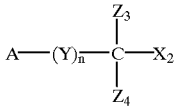

In the formula (II), symbol "A" represents an alkyl group, an aryl group, or a heterocyclic group, $Z_3$ and $Z_4$ independently represent a halogen atom, $X_2$ represents a hydrogen atom or an electron withdrawing group, Y represents —C(=O)—, —SO— or —$SO_2$—, and symbol "n" represents 0 or 1.

The aryl group represented by the symbol "A" may be monocyclic, or may have a condensed ring structure. Preferably, the aryl group is a monocyclic or bicyclic aryl group having from 6 to 30 carbon atoms (e.g., phenyl, naphthyl, etc.). More preferred examples include a phenyl group or a naphthyl group, and a further preferred example includes a phenyl group.

The heterocyclic group represented by the symbol "A" is a 3-membered to 10-membered, saturated or unsaturated heterocyclic group having at least one of N, O or S atoms. The heterocyclic group may be monocyclic or may form a condensed ring structure with any other rings. The heterocyclic group is preferably a 5- or 6-membered unsaturated heterocyclic group optionally having a condensed ring structure, more preferably a 5- or 6-membered aromatic heterocyclic group optionally having a condensed ring structure. A nitrogen-containing 5- or 6-membered aromatic heterocyclic group optionally having a condensed ring structure is more preferred, and a 6-membered aromatic heterocyclic group having from 1 to 4 nitrogen atoms and optionally having a condensed ring structure is most preferred.

Specific examples of the hetero ring in the heterocyclic group include pyrrolidine, piperidine, piperazine, morpholine, thiophene, furan, pyrrole, imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, benzoselenazole, indolenine, tetrazaindene and the like. Preferred hetero ring include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, indolenine, and tetrazaindene. More preferred examples include imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetrazaindene. Further preferred examples include imidazole, pyridine, pyrimidine, pyrazine, pyridazine, triazole, triazine, thiadiazole, quinoline, phthalazine, naphthyridine, quinoxaline, quinazoline, cinnoline, tetrazole, thiazole, benzimidazole and benzthiazole; and most preferred examples include pyridine, thiadiazole, quinoline, and benzthiazole.

The aryl or heterocyclic group represented by the symbol "A" may have one or more substituents in addition to —(Y)—$_n$—C($X_2$)($Z_3$)($Z_4$). Examples of such substituents include, for example, an alkyl group having preferably from 1 to 20, more preferably from 1 to 12, most preferably from 1 to 8 carbon atoms, such as methyl group, ethyl n-propyl group, isopropyl group, n-butyl group, iso-butyl group, tert-butyl group, n-octyl group, n-decyl group, n-hexadecyl group, cyclopropyl group, cyclopentyl group, cyclohexyl group, etc.; an alkenyl group having preferably from 2 to 20, more preferably from 2 to 12, most preferably from 2 to 8 carbon atoms, such as vinyl group, allyl group, 2-butenyl group, 3-pentenyl group, etc.; an alkynyl group having preferably from 2 to 20, more preferably from 2 to 12, most preferably from 2 to 8 carbon atoms, such as propargyl group, 3-pentynyl group, etc.; an aryl group having preferably from 6 to 30, more preferably from 6 to 20, most preferably from 6 to 12 carbon atoms, such as phenyl group, p-methylphenyl group, naphthyl group, etc.; an amino group having preferably from 0 to 20, more preferably from 0 to 10, most preferably from 0 to 6 carbon atoms, such as amino group, methylamino group, dimethylamino group, diethylamino group, dibenzylamino group, etc.; an alkoxy group having preferably from 1 to 20, more preferably from 1 to 12, most preferably from 1 to 8 carbon atoms, such as methoxy group, ethoxy group, butoxy group, etc.; an aryloxy group having preferably from 6 to 20, more preferably from 6 to 16, most preferably from 6 to 12 carbon atoms, such as phenyloxy group, 2-naphthyloxy group, etc.; an acyl group having preferably from 1 to 20, more preferably from 1 to 16, most preferably from 1 to 12 carbon atoms, such as acetyl group, benzoyl group, formyl group, pivaloyl group, etc.; an alkoxycarbonyl group having preferably from 2 to 20, more preferably from 2 to 16, most preferably from 2 to 12 carbon atoms, such as methoxycarbonyl group, ethoxycarbonyl group, etc.; an aryloxycarbonyl group having preferably from 7 to 20, more preferably from 7 to 16, most preferably from 7 to 10 carbon atoms, such as phenyloxycarbonyl group, etc.; an acyloxy group having preferably from 2 to 20, more preferably from 2 to 16, most preferably from 2 to 10 carbon atoms, such as acetoxy group, benzoyloxy group, etc.; an acylamino group having preferably from 2 to 20, more preferably from 2 to 16, most preferably from 2 to 10 carbon atoms, such as acetylamino group, benzoylamino group, etc.; an alkoxycarbonylamino group having preferably from 2 to 20, more preferably from 2 to 16, most preferably from 2 to 12 carbon atoms, such as methoxycarbonylamino group, etc.; an aryloxycarbonylamino group having preferably from 7 to 20, more preferably from 7 to 16, most preferably from 7 to 12 carbon atoms, such as phenyloxycarbonylamino group, etc.; a sulfonylamino group having preferably from 1 to 20, more preferably from 1 to 16, most preferably from 1 to 12 carbon atoms, such as methanesulfonylamino group, benzenesulfonylamino group, etc.; a sulfamoyl group having preferably from 0 to 20, more preferably from 0 to 16, most preferably from 0 to 12 carbon atoms, such as sulfamoyl group, methylsulfamoyl group, dimethylsulfamoyl group, phenylsulfamoyl group, etc.; a carbamoyl group having preferably from 1 to 20, more preferably from 1 to 16, most preferably from 1 to 12 carbon atoms, such as carbamoyl group, methylcarbamoyl group, diethylcarbamoyl group, phenylcarbamoyl group, etc.; an alkylthio group having preferably from 1 to 20, more preferably from 1 to 16, most preferably from 1 to 12 carbon atoms, such as methylthio group, ethylthio group, etc.; an arylthio group having preferably from 6 to 20, more preferably from 6 to 16, most preferably from 6 to 12 carbon atoms, such as phenylthio group, etc.; a sulfonyl group having preferably from 1 to 20, more preferably from 1 to 16, most preferably from 1 to 12 carbon atoms, such as mesyl group, tosyl group, phenylsulfonyl group, etc.; a sulfinyl group having preferably from 1 to 20, more preferably from 1 to 16, most preferably from 1 to 12 carbon atoms, such as methanesulfinyl group, benzenesulfinyl group, etc.; an ureido group having preferably from 1 to 20, more preferably from 1 to 16, most preferably from 1 to 12 carbon atoms, such as ureido group, methylureido group, phenylureido group, etc.; a phosphoric acid amido group having preferably from 1 to 20, more preferably from 1 to 16, most preferably from 1 to 12 carbon atoms, such as diethylphosphoric acid amido group, phenylphosphoric acid amido group, etc.; a hydroxyl group; a mercapto group; a halogen atom (e.g., fluorine atom, chlorine atom, bromine atom, iodine atom); a cyano group; a sulfo group; a carboxyl group; a nitro group; a hydroxamic acid group; a sulfino group; a hydrazino group; a heterocyclic group (e.g., imidazolyl group, pyridyl group, furyl group, piperidyl group, morpholino group, etc.), etc. These substituents may be further substituted. Two or more substituents, if present, may be the same or different.

Among these substituents, preferred examples include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, an ureido group, a phosphoric acid amide group, a halogen atom, a cyano group, a sulfo group, a carboxyl group, a nitro group, and a heterocyclic group; more preferred examples include an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, an ureido group, a phosphoric acid amide group, a halogen atom, a cyano group, a nitro group, and a heterocyclic group; even more preferred examples include an alkyl group, an aryl group, an alkoxy group, an aryloxy group, an acyl group, an acylamino group, a sulfonylamino group, a sulfamoyl group, a carbamoyl group, a halogen atom, cyano group, nitro group and a heterocyclic group; and most preferred are an alkyl group, an aryl group, a sulfamoyl group, a carbamoyl group, and a halogen atom.

The alkyl group represented by the symbol "A" may be linear, branched, cyclic, or a combination thereof. Preferably, the alkyl group has from 1 to 30 carbon atoms, more preferably from 1 to 15 carbon atoms, including, for example, a methyl group, an ethyl group, an n-propyl group, an isopropyl group, a tert-octyl group and the like.

The alkyl group represented by the symbol "A" may have one or more substituents in addition to $—(Y)_n—C(X_2)(Z_3)(Z_4)$. Examples of such substituents include those mentioned as substituents for the heterocyclic or aryl group represented by the symbol "A". Preferred substituents include a carbamoyl group, a sulfamoyl group, an alkenyl group, an aryl group, an alkoxy group, an aryloxy group, an acyloxy group, an acylamino group, an alkoxycarbonylamino group, an aryloxycarbonylamino group, a sulfonylamino group, an alkylthio group, an arylthio group, an ureido group, a phosphoric acid amide group, a hydroxyl group, a halogen atom, and a heterocyclic group; more preferred substituents include a carbamoyl group, a sulfamoyl group, an aryl group, an alkoxy group, an aryloxy group, an acylamino group, an alkoxycarbonylamino group, an aryloxycarbonylamino group, a sulfonylamino group, an ureido group, a phosphoric acid amide group, and a halogen atom; and even more preferred substituents include a carbamoyl group, a sulfamoyl group, an aryl group, an alkoxy group, an aryloxy group, an acylamino group, a sulfonylamino group, an ureido group, and a phosphoric acid amide group. These substituents may be further substituted. Two or more substituents, if present, may be the same or different.

Y represents —C(=O)—, —SO— or $—SO_2—$, preferably —C(=O)— or $—SO_2—$, and more preferably $—SO_2—$. The symbol "n" represents 0 or 1, and is preferably 1. $Z_3$ and $Z_4$ independently represent a halogen atom, and the halogen atoms represented by $Z_3$ and $Z_4$ may be the same or different. The halogen atom includes, for example, fluorine, chlorine, bromine, and iodine atoms; and is preferably chlorine, bromine, or iodine atoms, more preferably chlorine or bromine atoms, and most preferably bromine atom.

$X_2$ represents a hydrogen atom or an electron withdrawing group. The electron withdrawing group represented by $X_2$ is a substituent having σp of a positive value, preferably at least 0.01, more preferably at least 0.1. As for the Hammett's substituent constant σp, for example, Journal of Medicinal Chemistry, 1973, Vol. 16, No. 11, pp. 1207–1216 can be referred to. The electron withdrawing group includes, for example, a halogen atom (e.g., fluorine atom with σp of 0.06, chlorine atom with σp of 0.23, bromine atom with σp of 0.23, iodine atom with σp of 0.18), a trihalomethyl group (e.g., tribromomethyl with σp of 0.29, trichloromethyl with σp of 0.33, trifluoromethyl with σp of 0.54), a cyano group with σp of 0.66, a nitro group with σp of 0.78, an aliphatic, aryl or heterocyclic sulfonyl group (e.g., methanesulfonyl with σp of 0.72), an aliphatic, aryl or heterocyclic acyl group (e.g., acetyl with σp of 0.50, benzoyl with σp of 0.43), an alkynyl group (e.g., C≡CH with σp of 0.23), an aliphatic, aryl or heterocyclic oxycarbonyl group (e.g., methoxycarbonyl with σp of 0.45), phenoxycarbonyl with σp of 0.44), a carbamoyl group with σp of 0.36, a sulfamoyl group with σp of 0.57 and the like.

Preferably, $X_2$ is an electron withdrawing group. More preferred examples include a halogen atom, an aliphatic, aryl, or heterocyclic sulfonyl group, an aliphatic, aryl, or heterocyclic acyl group, an aliphatic, aryl, or heterocyclic oxycarbonyl group, a carbamoyl group, or a sulfamoyl group; and a most preferred example includes a halogen atom. Among the halogen atom, chlorine, bromine or iodine atom is preferred; and chlorine or bromine atom is more preferred. Bromine atom is most preferred.

Preferred examples of the compounds of the formula (II) include compounds of the following formula (II-a):

Formula (II-a)

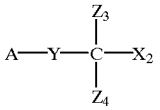

wherein the symbol "A" has the same meaning as that defined in the formula (II), and its preferred scope is the same as those explained above. Substituents which may optionally attach to the group A are the same as those substitutable on the group A in the formula (II). $Z_3$, $Z_4$, Y and $X_2$ have the same meanings as those in the formula (II), and their preferred scope are the same as those mentioned above.

Among compounds of the formula (II), more preferred examples include compounds of the following formula (II-b):

Formula (II-b)

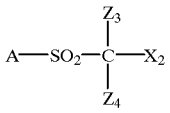

wherein the symbol "A" has the same meaning as that defined in the formula (II), and its preferred scope is the same as those explained above. Substituents which may optionally attach to the group A are the same as those substitutable on the group A in the formula (II). $Z_3$, $Z_4$, Y and $X_2$ have the same meanings as those in the formula (II), and their preferred scope are the same as those mentioned above.

Specific examples of the compound of the formula (II) include those disclosed in Japanese Patent Laid-open Publication (Kokai, hereinafter referred to as JP-A) 10-339934 as compounds of II-1 to II-38 represented by the general formula (II) and the like.

The organic polyhalogenated compound represented by the formula (1), which is used as an essential component in the photothermographic material of the present invention, may be used as a combination of two or more different compounds.

In the formula (1), $Z_1$ and $Z_2$ independently represent a halogen atom (fluorine, chlorine, bromine and iodine). It is most preferred that both of $Z_1$ and $Z_2$ are bromine atoms.

In the formula (1), $X_1$ represents a hydrogen atom or an electron withdrawing group. As the electron withdrawing group, those explained as for $X_2$ in the formula (II) can be used. Preferred examples of the electron withdrawing group include, for example, cyano group, an alkoxycarbonyl group, an aryloxycarbonyl group, a carbamoyl group, a sulfamoyl group, an alkylsulfonyl group, an arylsulfonyl group, a halogen atom, an acyl group, a heterocyclic group and the like. More preferred examples include hydrogen atom and a halogen atom, and a most preferred example includes bromine atom. In the formula (1), $Y_1$ represents —CO— group or —$SO_2$— group, and preferably represents —$SO_2$— group.

In the formula (1), Q represents an arylene group or a divalent heterocyclic group.

The arylene group represented by Q in the formula (1) is preferably a monocyclic or condensed ring arylene group having 6 to 30 carbon atoms, preferably a monocyclic or condensed ring arylene group having 6 to 20 carbon atoms. Examples thereof include, for example, phenylene, naphthylene and so forth, and phenylene group is most preferred. The arylene group represented by Q may have one or more substituents, and the substituent may be any group so long as it does not adversely affect photographic performance. Examples thereof include, for example, a halogen atom (fluorine atom, chlorine atom, bromine atom or iodine atom), an alkyl group (including an aralkyl group, a cycloalkyl group, an active methine group and so forth), an alkenyl group, an alkynyl group, an aryl group, a heterocyclic group (including N-substituted nitrogen-containing heterocyclic group such as morpholino group), a quaternized nitrogen-containing heterocyclic group (e.g., pyridinio group), an acyl group, an alkoxycarbonyl group, an aryloxycarbonyl group, a carbamoyl group, carboxyl group or a salt thereof, an imino group, an imino group substituted at the N atom, a thiocarbonyl group, a carbazoyl group, a cyano group, a thiocarbamoyl group, an alkoxy group (including a group containing an ethyleneoxy group or propyleneoxy group repeating unit), an aryloxy group, a heterocyclyloxy group, an acyloxy group, an (alkoxy or aryloxy)carbonyloxy group, a sulfonyloxy group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an (alkyl or aryl)sulfonylureido group, a nitro group, an (alkyl, aryl or heterocyclyl)thio group, an acylthio group, an (alkyl or aryl)sulfonyl group, an (alkyl or aryl)sulfinyl group, hydroxyl group, sulfo group or a salt thereof, a sulfamoyl group, a phosphoryl group, a group containing phosphoric acid amide or phosphoric acid ester structure, a silyl group and so forth. These substituents may further be substituted with one or more of the aforementioned substituents.

Particularly preferred substituents on the arylene group represented by Q in the formula (1) include an alkyl group, an alkoxy group, an aryloxy group, a halogen atom, carboxyl group or a salt thereof, a salt of sulfo group and phosphoric acid group.

In the formula (1), the hetero ring of the divalent heterocyclic group represented by Q may be a saturated or partially saturated or aromatic 5- to 7-membered hetero ring containing at least one of N, O and S atoms. The hetero ring may consist of a single ring, or may form a condensed ring with one or more of other rings. Examples of the hetero ring in the heterocyclic group represented by Q include, for example, rings of pyridine, pyrazine, pyrimidine, benzothiazole, benzimidazole, thiadiazole, quinoline, isoquinoline, triazole and the like. The heterocyclic group may have one or more substituents, and examples of the substituent include, for example, those mentioned as for the substituent on the aryl group represented by Q.

In the formula (1), Q is preferably an arylene group, and most preferably a phenylene group. When Q represents a phenylene group, —$Y_1$—$C(X_1)(Z_1)(Z_2)$— and —$(L)_n$—$CON(W_1)(W_2)$ are preferably present in meta-position relative to each other.

In the formula (1), L represents a divalent linking group, for example, an alkylene group (having preferably 1 to 30 carbon atoms, more preferably 1 to 20 carbon atoms, most preferably 1 to 10 carbon atoms), an arylene group (having preferably 6 to 30 carbon atoms, more preferably 6 to 20 carbon atoms, most preferably 6 to 10 carbon atoms), an alkenylene group (having preferably 2 to 30 carbon atoms, more preferably 2 to 20 carbon atoms, most preferably 2 to 10 carbon atoms), an alkynylene group (having preferably 2 to 30 carbon atoms, more preferably 2 to 20 carbon atoms, most preferably 2 to 10 carbon atoms), a divalent heterocyclic group (having preferably 1 to 30 carbon atoms, more preferably 1 to 20 carbon atoms, most preferably 1 to 10 carbon atoms), —O— group, —NR— group, —CO— group, —S— group, —SO— group, —$S_2$— group, a group containing phosphorus atom, a group composed of a combination of the foregoing groups or the like (the group represented by R in the above description is a hydrogen atom, an alkyl group which may be substituted, or an aryl group which may be substituted).

The linking group represented by L in the formula (1) may be substituted, and examples of the substituents include those explained as substituents for the arylene group represented by Q.

The linking group represented by L in the formula (1) is preferably an alkylene group, an arylene group, —O— group, —NRCO— group, —$SO_2$NR— group or a group composed of a combination of these groups.

In the formula (1), n represents 0 or 1, and preferably 0.

In the formula (1), $W_1$ and $W_2$ independently represent a hydrogen atom, an alkyl group, an aryl group, or a heterocyclic group.

The alkyl group represented by $W_1$ and $W_2$ in the formula (1) may be any of liner, branched, cyclic, or a combination thereof. The alkyl group has preferably 1 to 20 carbon atoms, more preferably 1 to 12 carbon atoms, most preferably 1 to 6 carbon atoms. Examples thereof include, for example, methyl group, ethyl group, n-propyl group, iso-propyl group, n-butyl group, sec-butyl group, iso-butyl group, n-pentyl group, sec-pentyl group, iso-pentyl group, 3-pentyl group, n-hexyl group, n-octyl group, n-dodecyl group, cyclohexyl group and the like.

The alkyl group represented by $W_1$ and $W_2$ in the formula (1) may be substituted, and examples of the substituents include those mentioned as substituents for the arylene group represented by Q. The substituents of the alkyl group represented by $W_1$ and $W_2$ in the formula (1) are preferably a halogen group, an alkenyl group, an alkynyl group, an aryl group, a heterocyclic group, a carbamoyl group, an alkoxy group, an aryloxy group, a sulfonamide group, an (alkyl or aryl)thio group, an (alkyl or aryl)sulfonyl group, sulfo group or a salt thereof, carboxyl group or a salt thereof, phosphoric acid group or a salt thereof or hydroxyl group, more preferably a halogen group, an alkenyl group, an alkynyl group, an aryl group, an aryl group, a carbamoyl group, an alkoxy group, an aryloxy group, an (alkyl or aryl)thio group, sulfo group or a salt thereof, carboxyl group or a salt thereof or hydroxyl group, most preferably a halogen group, an alkenyl group, a carbamoyl group, an alkoxy group, an alkylthio group, a salt of sulfo group, carboxyl group or a salt thereof or hydroxyl group.

The aryl group represented by $W_1$ and $W_2$ in the formula (1) is a monocyclic or condensed ring aryl group having preferably 6 to 20 carbon atoms, more preferably 6 to 16 carbon atoms, most preferably 6 to 10 carbon atoms. Examples thereof include, for example, phenyl group, naphthyl group and so forth, and phenyl group is preferred. The aryl group represented by $W_1$ and $W_2$ may be substituted, and examples of the substituents include those mentioned for the substituents on the alkyl group represented by $W_1$ and $W_2$.

The heterocyclic group represented by $W_1$ and $W_2$ in the formula (1) may be a saturated or unsaturated 5- to 7-membered heterocyclic group containing at least one of N, O and S atoms. The heterocyclic group may consist of a single ring, or it may form a condensed ring with one or more other rings. Examples of the heterocyclic group include, for example, pyridyl, pyrazinyl, pyrimidinyl, thiazolyl, imidazolyl, benzothiazolyl, benzimidazolyl, thiadiazolyl, quinolyl, isoquinolyl, triazolyl and the like. These rings may be substituted. Examples of the substituents include those mentioned for the substituents on the alkyl group represented by $W_1$ and $W_2$, and the preferred scope thereof is similar to that of those substituents. $W_1$ and $W_2$ may be the same or different from each other, and they may bind to each other to form a cyclic structure. $W_1$ and $W_2$ preferably represent a hydrogen atom, an alkyl group or an aryl group, most preferably a hydrogen atom or an alkyl group.

Specific examples of the organic polyhalogenated compound represented by the formula (1) are listed below. However, the polyhalogenated compounds that can be used for the present invention are not limited to these examples.

P-1

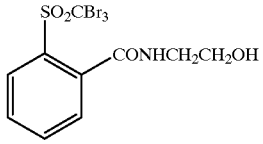

P-2

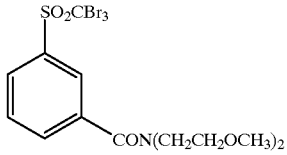

P-3

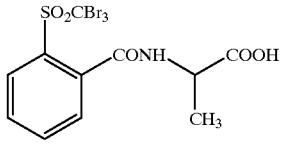

P-4

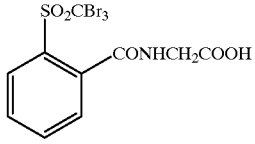

P-5

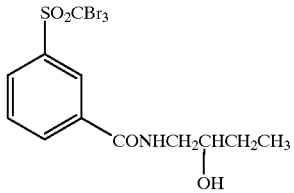

P-6

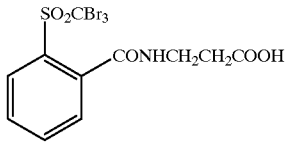

P-7

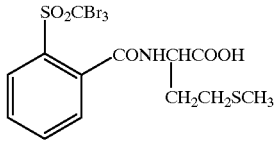

P-8

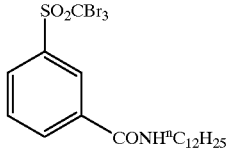

P-9

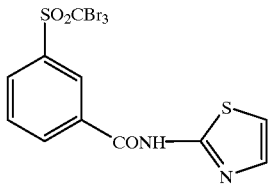

-continued
P-10
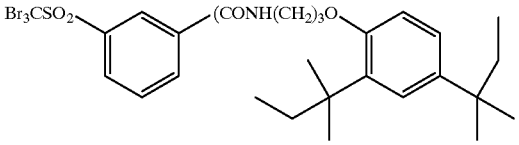
P-11
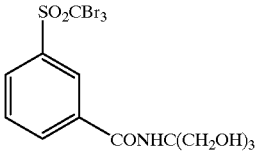
P-12
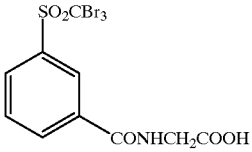
P-13
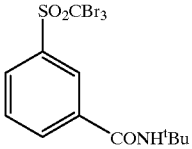
P-14
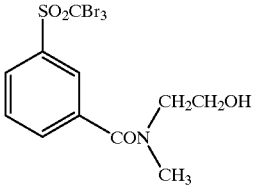
P-15
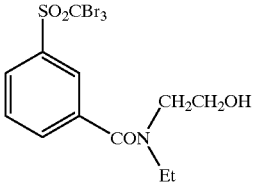
P-16
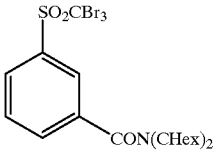
P-17
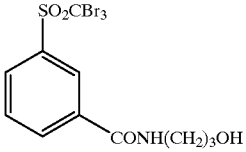
P-18
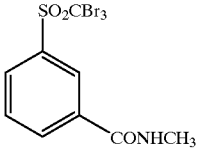
-continued
P-19
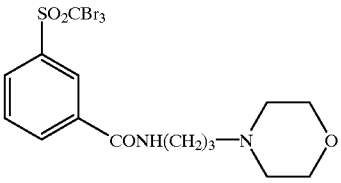
P-20
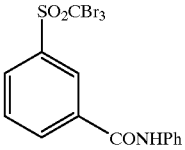
P-21
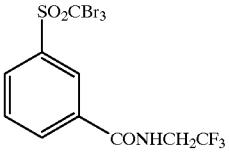
P-22
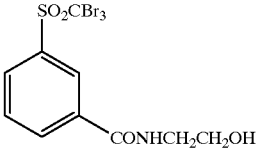
P-23
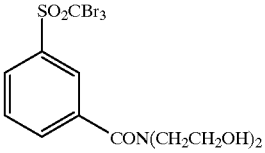
P-24
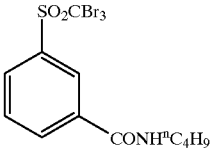
P-25
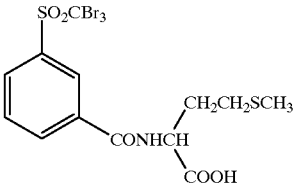
P-26
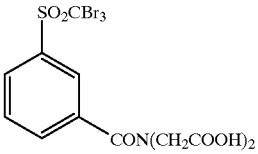
P-27
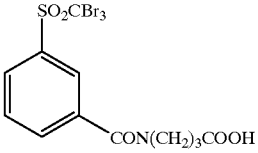

-continued
P-28
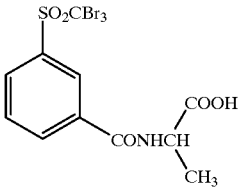
P-29
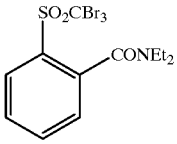
P-30
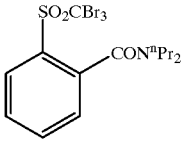
P-31
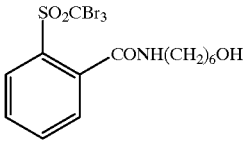
P-32
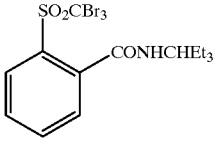
P-33
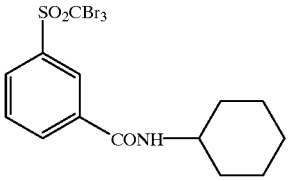
P-34
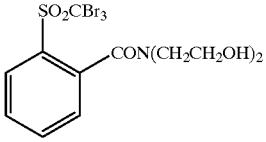
P-35
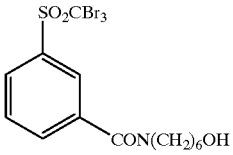
P-36
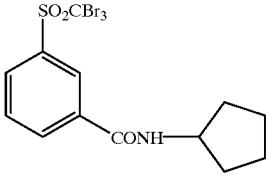
-continued
P-37
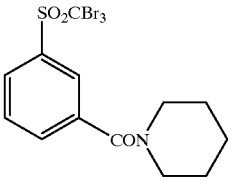
P-38
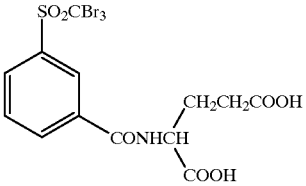
P-39
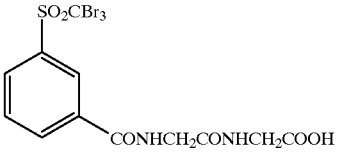
P-40
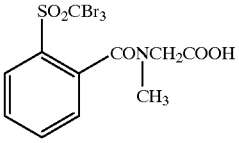
P-41
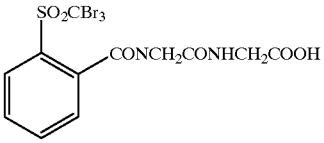
P-42
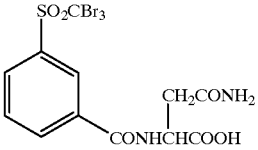
P-43
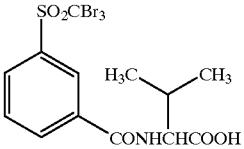
P-44
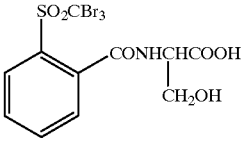
P-45
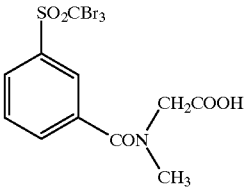

-continued
P-46
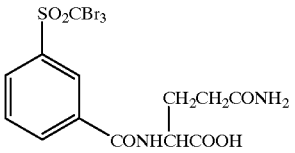
P-47
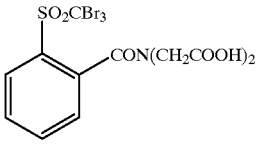
P-48
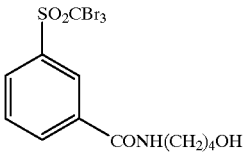
P-49
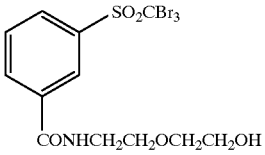
P-50
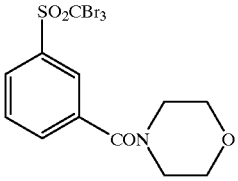
P-51
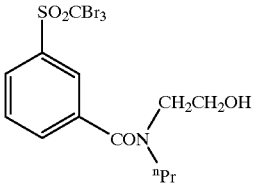
P-52
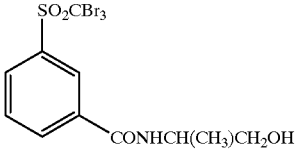
P-53
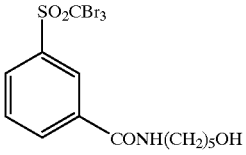
P-54
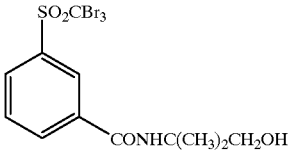
-continued
P-55
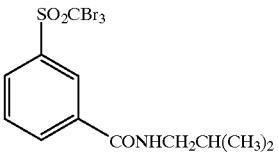
P-56
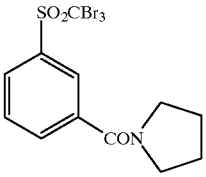
P-57
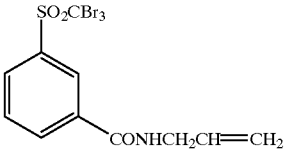
P-58
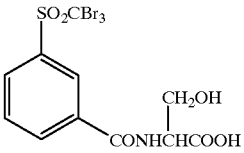
P-59
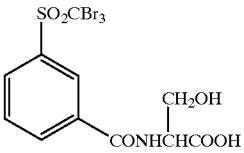
P-60
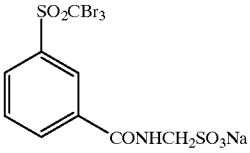
P-61
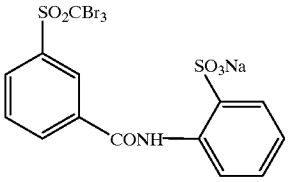
P-62
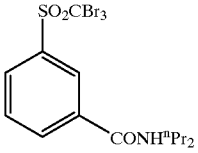
P-63
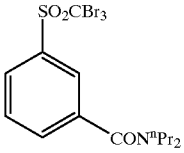

-continued
P-64
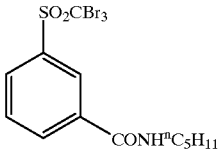
P-65
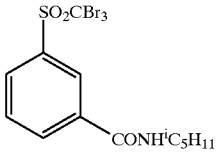
P-66
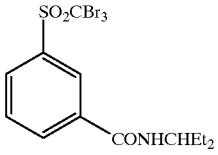
P-67
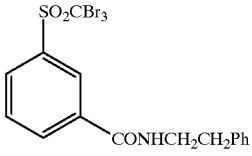
P-68
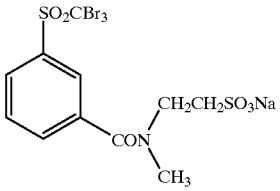
P-69
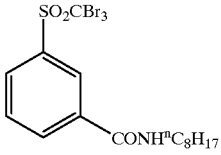
P-70
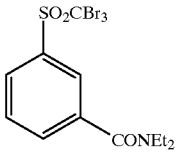
P-71
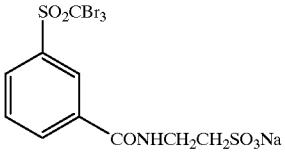
P-72
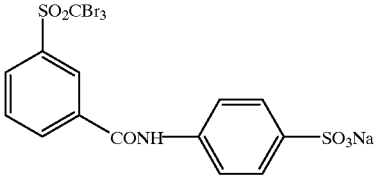
-continued
P-73
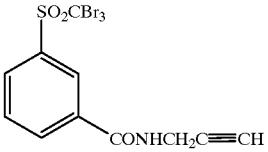
P-74
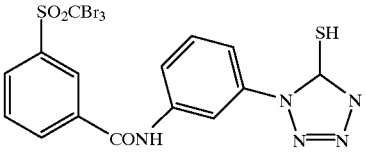
P-75
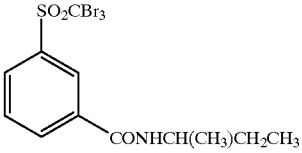
P-76
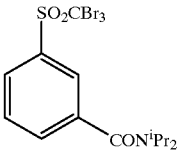
P-77
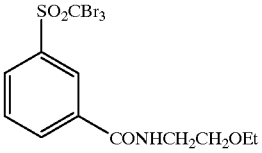
P-78
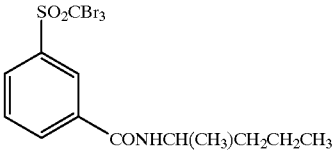
P-79
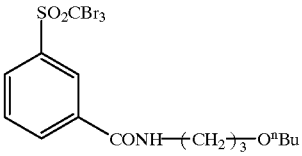
P-80
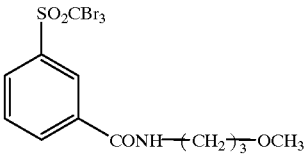
P-81
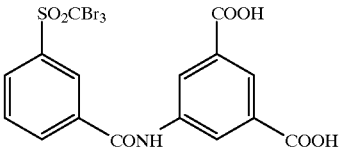

-continued
P-82
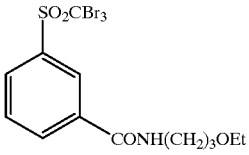
P-83
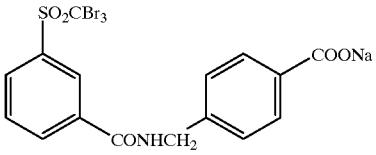
P-84
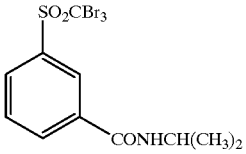
P-85
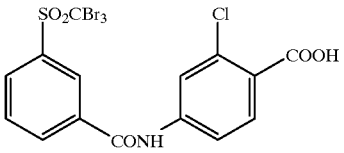
P-86
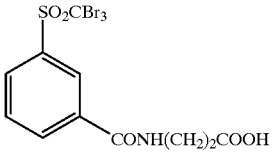
P-87
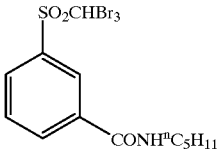
P-88
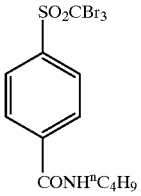
P-89
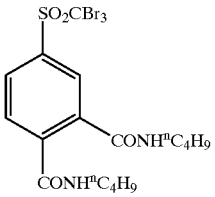
P-90
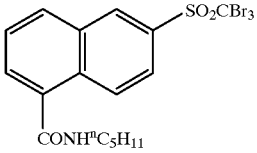
-continued
P-91
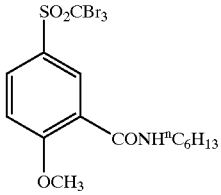
P-92
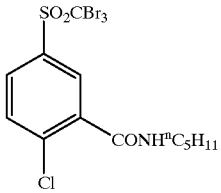
P-93
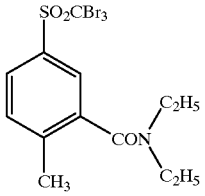
P-94
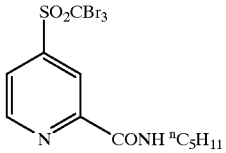
P-95
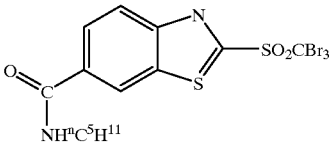
P-96
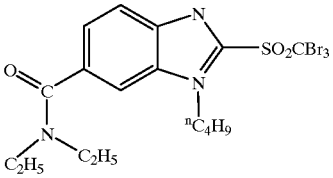
P-97
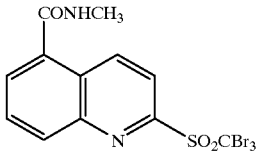
P-98
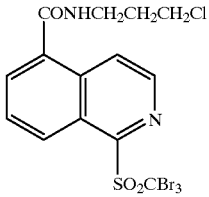

-continued
P-99
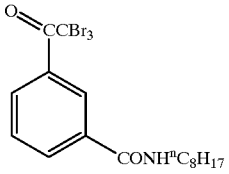
P-100
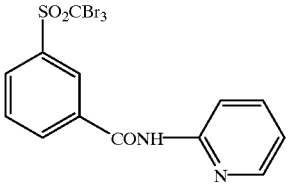
P-101
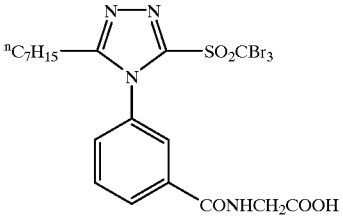
P-102
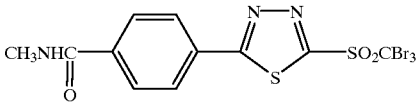
P-103
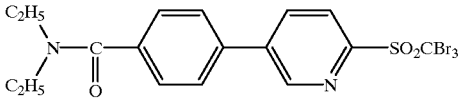
P-104
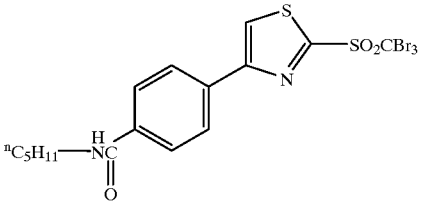
P-105
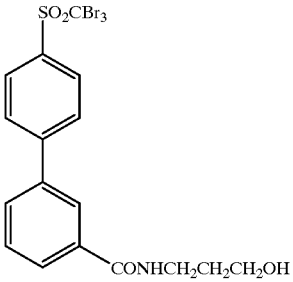
P-106
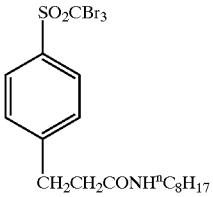
-continued
P-107
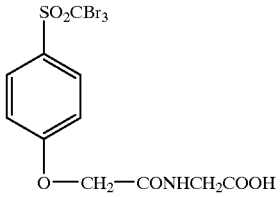
P-108
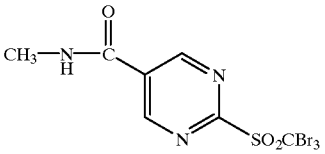
P-109
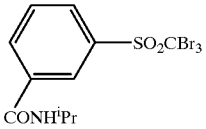
P-110
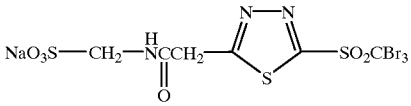
P-111
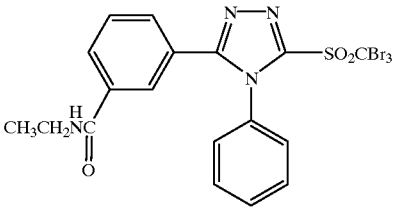
P-112
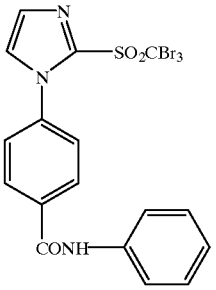
P-113
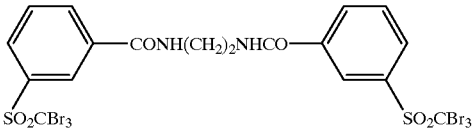
P-114
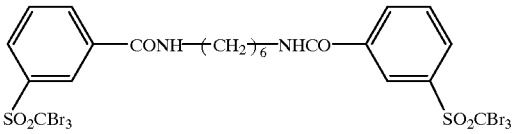

-continued

P-115

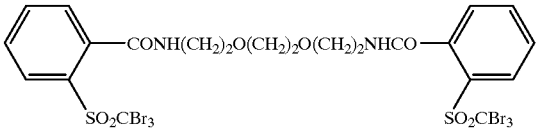

P-116

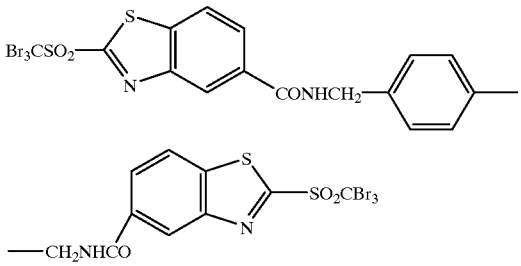

P-117

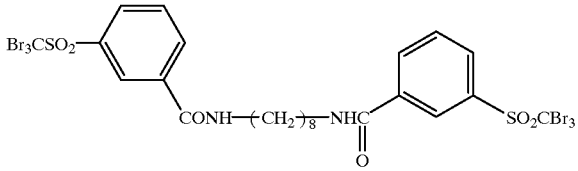

The aforementioned organic polyhalogenated compounds can be used by dissolving said compounds in water or a suitable organic solvent, for example, alcohols such as methanol, ethanol, propanol and fluorinated alcohol, ketones such as acetone, methyl ethyl ketone and methyl isobutyl ketone, dimethylformamide, dimethyl sulfoxide, methyl cellosolve and the like. The compounds bound with an acidic group may be neutralized with an equivalent alkali and may be added as salts.

A layer containing the organic polyhalogenated compound represented by the formula (1) is preferably formed by using an aqueous coating solution, and the organic polyhalogenated compound represented by the formula (1) is preferably used as an aqueous dispersion in the aqueous coating solution. Any dispersion method may be applied. An example of well known emulsification methods include a method for mechanically preparing an emulsified dispersion using an oil such as dibutyl phthalate, tricresyl phosphate, glyceryl triacetate, or diethyl phthalate, ethyl acetate or cyclohexanone as an auxiliary solvent for dissolution. An example of solid dispersion methods includes a method for preparing a solid dispersion by dispersing powder of the compound in a suitable solvent such as water using a ball mill, a colloid mill or the like or by means of ultrasonic wave. A protective colloid (e.g., polyvinyl alcohol), a surfactant (e.g., an anionic surfactant such as sodium triisopropylnaphthalenesulfonate: a mixture of those having three isopropyl groups at different positions)) and the like may be used for the above preparations. The particles in the aqueous dispersion preferably have a particle size of 0.1 to 1.0 $\mu$m, more preferably 0.15 to 0.60 $\mu$m.

The amount (total amount) of the organic polyhalogenated compounds is $1\times10^{-6}$ to 1 mole, preferably $1\times10^{-5}$ to 0.5 mole, more preferably $1\times10^{-3}$ to 0.3 mole, mole of the silver on the side of the image-forming layer. The amount of said compound is based on one mole of silver which is the sum of the silver halide and the silver salt of an organic acid. The polyhalogenated compounds may be added to any layers which are provided on a support on the side of an image-forming layer, i.e., the image-forming layer and/or other layers provided on the same side of the image-forming layer. The compounds may preferably be added to the image-forming layer or one or more layers adjacent thereto. The combination ratio of the polyhalogenated compound other than the polyhalogenated compound represented by the formula (1) and the polyhalogenated compound represented by the formula (1) is preferably in the range of 0.01:99.99 to 99.99:0.01, more preferably 5:95 to 95:5, most preferably 9:91 to 91:9.

A silver salt of an organic acid that can be used in the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source capable of reducing the silver ion. Such non-photosensitive silver salts of an organic acid are disclosed in JP-A-10-62899, paragraphs 0048 to 0049 and EP 0803763A1, page 18, line 24 to page 19, line 37. Silver salts of an organic acid, in particular, silver salts of a long chained aliphatic carboxylic acid (having from 10 to 30, preferably from 15 to 28 carbon atoms) are preferred. Preferred examples of the organic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and the like.

The shape of the silver salt of an organic acid that can be used for the present invention is not particularly limited. Scaly silver salts of an organic acid are preferred for the present invention. Scaly silver salts of an organic acid are herein defined as follows. A sample of a silver salt of an organic acid is observed under an electronic microscope, and the shape of the observed grains of the salt of an organic acid is approximated to rectangular parallelepiped. The edges of each rectangular parallelepiped are named as a, b and c according to increasing size (c and b may be the same). From the shorter edges a and b, x is obtained according to the following equation:

$$x=b/a$$

The values of x are obtained for about 200 grains, and an average of the value is named as x (average). Samples that satisfy the requirement of x (average) $\geqq 1.5$ are defined to be scaly. Scaly grains preferably satisfy $30 \geqq x$ (average) $\geqq 1.5$, more preferably $20 \geqq x$ (average) $\geqq 2.0$. Acicular grains satisfy $1 \leqq x$ (average) $<1.5$.

In scaly grains, "a" is interpreted as the thickness of tabular grains of which main planes are defined by the sides of b and c. The average of "a" is preferably from 0.01 $\mu$m to 0.23 $\mu$m, more preferably from 0.1 $\mu$m to 0.20 $\mu$m. The average of c/b is preferably from 1 to 6, more preferably from 1.05 to 4, most preferably from 1.1 to 3, most preferably from 1.1 to 2.

The grain size distribution of the silver salt of an organic acid is preferably monodispersion. The term "monodispersion" as used herein means that the percentage of the value obtained by dividing the standard deviation of the length of the short axis or the long axis by the length of the short axis or the long axis, respectively, is preferably 100% or less, more preferably 80% or less, further preferably 50% or less. The shape of the silver salt of an organic acid can be determined from a transmission electron microscope image of silver salt of an organic acid dispersion. Another method for determining monodispersion includes a method involving the step of obtaining the standard deviation of a volume-weighted average diameter of the silver salt of an organic acid. The percentage (coefficient of variation) of the value obtained by dividing the standard deviation by the volume-weighted average diameter is preferably 100% or less, more preferably 80% or less, further preferably 50% or less. For example, the value can be obtained from a grain size (volume-weighted average diameter) determined by irradiating silver salt of an organic acid dispersed in a solution with a laser ray and determining an autocorrelation function of the scattered light on the basis of the change in time.

The organic acid silver salt used for the present invention is prepared by reacting a solution or suspension of alkali metal salt (e.g., Na salt, K salt, Li salt) of the above-described organic acid to react with silver nitrate. The organic acid alkali metal salt can be obtained by treating the organic acid with an alkali. The preparation of the organic acid silver salt may be performed batchwise or continuously in an appropriate reaction vessel. Stirring in the reaction vessel may be effected by any stirring method depending on required properties of the grains. Any one of the methods including a method of gradually or rapidly adding an aqueous silver nitrate solution to a reaction vessel containing an organic acid alkali metal solution or suspension, a method of gradually or rapidly adding a organic acid alkali metal salt solution or suspension prepared beforehand to a reaction vessel containing an aqueous silver nitrate solution, or a method of simultaneously adding to a reaction vessel an aqueous silver nitrate solution and an organic acid alkali metal salt solution or suspension both of which are prepared beforehand, can be used as methods for preparing the organic acid silver salt,.

The aqueous silver nitrate solution and the organic acid alkali metal salt solution or suspension both having any arbitrary concentration may be used to control the grain size of the organic acid silver salt to be prepared, and may be added at any addition rate. As methods for adding the aqueous silver nitrate solution and the organic acid alkali metal salt solution or suspension, addition with at a constant rate or addition at an increasing or decreasing rate according to a time function. The solution may be added to the liquid surface of or into a solution of the reaction system. When an aqueous silver nitrate solution and an organic acid alkali metal salt solution or suspension, both are prepared beforehand, are simultaneously added to a reaction vessel, either of the aqueous silver nitrate solution and the organic acid alkali metal salt solution or suspension may be added in advance, and in this case, the aqueous silver nitrate solution is preferably added in advance. The amount added in advance is preferably from 0 to 50 volume %, more preferably from 0 to 25 volume %, of the entire amount to be added. Furthermore, a method described in JP-A-9-127643 wherein pH or silver potential of the reaction solution is controlled during the reaction may be preferably used.

The pH of the aqueous silver nitrate solution and the solution or suspension of an organic acid alkali metal salt to be added may be adjusted depending on the required properties of the grains. For adjusting the pH, any acid or alkali may be added. Furthermore, depending on the required property of the grains, for example, the temperature in the reaction vessel may be suitably chosen to control the grain size of the organic acid silver salt to be prepared. The aqueous silver nitrate solution and the organic acid alkali metal salt solution or suspension to be added may also be suitably prepared at any temperature. In order to keep liquid flowability of the solution or suspension of an organic acid alkali metal salt, the solution is preferably heated and maintained at a temperature of 50° C. or higher.

The organic acid silver salt for use in the present invention is preferably prepared in the presence of a tertiary alcohol. The tertiary alcohol having a total carbon number of 15 or less is preferred, and those having that of 10 or less is most preferred. Examples of preferred tertiary alcohols include tert-butanol. The tertiary alcohol may be added in any timing during the preparation of the organic acid silver salt. The tertiary alcohol is preferably added at the time of preparation of the organic acid alkali metal salt to dissolve the organic alkali metal salt. The tertiary alcohol may be added in any amount of from 0.01 to 10 as weight ratio based on the weight of $H_2O$ used as a solvent for the preparation of the organic acid silver salt, and preferably added in an amount of from 0.03 to 1.

A preferred scaly silver salt of an organic acid for use in the present invention may preferably prepared by reacting an aqueous solution of a water-soluble silver salt with an aqueous solution of an alkali metal salt of an organic acid in an aqueous tertiary alcohol solution in a reaction vessel (the method includes a step of adding the aqueous tertiary alcohol solution containing an alkali metal salt of an organic acid into a liquid filled in a reaction vessel), wherein the temperature difference between the liquid already in the reaction vessel and the aqueous tertiary alcohol solution of an alkali metal salt of an organic acid to be added thereto falls between 20° C. and 85° C., wherein the liquid in the reaction vessel is preferably an aqueous solution of a water-soluble silver salt put into the reaction vessel in advance, or alternatively, the liquid is water or a mixed solvent of water and a tertiary alcohol in a case where the aqueous solution of a water-soluble silver salt is not put into the reaction vessel in advance but is added from the start simultaneously with an aqueous solution of an alkali metal salt of an organic acid in a tertiary alcohol, as will be explained below, and when the aqueous solution of a water-soluble silver salt is put into the reaction vessel in advance, water or a mixed solvent of water and a tertiary alcohol may be filled in advance.

By maintaining the temperature difference during the addition of the aqueous tertiary alcohol solution containing an alkali metal salt of an organic acid, the crystal shape of the silver salt of an organic acid or the like can favorably controlled.

Silver nitrate is preferred as the water-soluble silver salt. The concentration of the water-soluble silver salt in the aqueous solution is preferably 0.03 mole/liter to 6.5 moles/liter, more preferably 0.1 mole/liter to 5 moles/liter. The pH of the aqueous solution is preferably 2 to 6, more preferably 3.5 to 6.

The aqueous solution of a water-soluble silver salt may contain a tertiary alcohol having from 4 to 6 carbon atoms. In that case, the amount of such tertiary alcohol in the aqueous solution is 70% by volume or less, preferably 50% by volume or less, based on the total volume of the aqueous solution. The temperature of the aqueous solution is preferably 0° C. to 50° C., more preferably 5° C. to 30° C. In a case where the aqueous solution of a water-soluble silver salt and the aqueous tertiary alcohol solution of an alkali metal salt of an organic acid are simultaneously added in the manner as mentioned below, the temperature is most preferably 5° C. to 15° C.

Specific examples of the alkali metal of the alkali metal salt of an organic acid include Na and K. The alkali metal salt of an organic acid may be prepared by adding NaOH or KOH to an organic acid. In this step, the amount of the alkali is preferably not larger than the equivalent amount of the organic acid so as to reserve non-reacted organic acid. In this case, the amount of the remaining non-reacted organic acid may be 3 mole % to 50 mole %, preferably 3 mole % to 30 mole %, per mole of the total organic acid. Preparation may also be carried out by adding an alkali in an amount larger than the prescribed amount, and then neutralizing the excess alkali by addition of an acid such as nitric acid or sulfuric acid.

Depending on the required properties of the silver salt of an organic acid, the pH of the reaction system may be controlled. For controlling the pH, any acid or alkali may be used.

The aqueous solution containing a water-soluble silver salt, the aqueous tertiary alcohol solution of an alkali metal salt of an organic acid, or the liquid in the reaction vessel may be optionally added with compounds of the formula (1) described in JP-A-62-65035, water-soluble group-containing N-heterocyclic compounds such as those described in JP-A-62-150240, inorganic peroxides such as those described in JP-A-50-101019, sulfur compounds such as those described in JP-A-51-78319, disulfide compounds such as those described in JP-A-57-643, hydrogen peroxide and the like.

The aqueous tertiary alcohol solution of an alkali metal salt of an organic acid is preferably in a mixed solvent of water and a tertiary alcohol having 4 to 6 carbon atoms to obtain uniformity of the solution. Alcohols in which the number of carbon atoms exceeds the defined range are not preferred as their miscibility with water becomes poor. Among the tertiary alcohol having 4 to 6 carbon atoms, most preferred is tert-butanol as its water-miscibility is the highest. Alcohols other than tertiary alcohols are also unfavorable as mentioned above since they have a reducing property and adversely affect the process of forming the silver salt of an organic acid. The amount of the tertiary alcohol that may be used in the aqueous tertiary alcohol solution of an alkali metal salt of an organic acid may be 3% by volume to 70% by volume, preferably 5% by volume to 50% by volume, relative to the volume of water in the aqueous solution.

The concentration of the alkali metal salts of an organic acid in the aqueous tertiary alcohol solution of the alkali metal salts of an organic acid may be 7% by weight to 50% by weight, preferably 7% by weight to 45% by weight, more preferably 10% by weight to 40% by weight.

The temperature of the aqueous tertiary alcohol solution of an alkali metal salt of an organic acid to be added in a reaction vessel is preferably from 50° C. to 90° C., more preferably from 60° C. to 85° C., most preferably from 65° C. to 85° C. to keep a temperature sufficient for preventing crystallization or solidification of an alkali metal salt of an organic acid. In order to control a constant reaction temperature, the temperature is preferably controlled at a constant temperature chosen from the above range.

The silver salt of an organic acid preferably used for the present invention may be prepared by i) a method comprising the step of adding an aqueous tertiary alcohol solution of an alkali metal salt of an organic acid as a single portion to a total amount of an aqueous solution of a water-soluble silver salt already put into a reaction vessel, or ii) a method comprising a time period of simultaneous addition of both of an aqueous solution of a water-soluble silver salt and an aqueous tertiary alcohol solution of an alkali metal salt of an organic acid into a reaction vessel (simultaneous addition method). In the present invention, the latter simultaneous addition method is preferred to control mean grain size of the silver salt of an organic acid and to achieve narrow grain size distribution. In this method, it is desirable that at least 30% by volume, more preferably from 50 to 75% by volume, of a total volume to be added is simultaneously added in a reaction vessel. In a case where either one is added in a reaction vessel in advance, it is desirable that the solution of a water-soluble silver salt is first added in the vessel.

In any case, the temperature of a liquid in a reaction vessel (the liquid is the aqueous solution of a water-soluble silver salt put in a reaction vessel in advance as mentioned above; or when the aqueous solution of a water-soluble silver salt is not added in a reaction vessel in advance, the liquid is a solvent already put in the vessel in advance as described below) is preferably 5° C. to 75° C., more preferably 5° C. to 60° C., most preferably 10° C. to 50° C. Throughout the reaction process, the reaction temperature is preferably controlled at a constant temperature falling within the above-defined range. The reaction temperature may also be preferably controlled according to several temperature patterns within the above-defined range.

The temperature difference between the liquid in a reaction vessel and the aqueous tertiary alcohol solution of an alkali metal salt of an organic acid is preferably 20° C. to 85° C., more preferably 30° C. to 80° C. The temperature of the aqueous tertiary alcohol solution of an alkali metal salt of an organic acid may preferably be higher than the other.

By performing the process as described above, a rate of precipitation as fine crystals, occurred by rapid cooling in a reaction vessel of the aqueous tertiary alcohol solution of an alkali metal salt of an organic acid that is kept at a high temperature, and a rate of forming a silver salt of an organic acid by reaction with the water-soluble silver salt are both favorably controlled, thereby crystal shape, crystal size and crystal size distribution of the silver salt of an organic acid can be preferably controlled. In addition, the properties of thermally processed materials particularly as photothermographic materials can also be improved.

The reaction vessel may contain a solvent beforehand, and water is preferably used as the solvent filled in advance. A mixed solvent of water and a tertiary alcohol may also be preferably used.

The aqueous tertiary alcohol solution of an alkali metal salt of an organic acid, the aqueous solution of a water-soluble silver salt, or the reaction mixture may optionally be added with a dispersing aid that is soluble in an aqueous medium. Any dispersing aids may be used so far that they are capable of dispersing the silver salt of an organic acid formed. Specific examples thereof include those mentioned below as dispersing aids for silver salt of an organic acid.

In the process of producing silver salt of an organic acid, desalting and dehydration may preferably carried out after the formation of the salt. The methods for desalting and dehydration are not particularly limited, and well known and ordinarily used methods may be applied. For example, known filtration methods such as centrifugation filtration, suction filtration, ultrafiltration, flocculation by the coagulation method followed by washing with water and the like, or supernatant removal by centrifugal precipitation may preferably be applied. The desalting and dehydration may be performed once or may be repeated several times. Addition and removal of water may be effected continuously or separately. The desalting and the dehydration are preferably carried out so as to obtain a conductivity of 300 $\mu$S/cm or less, more preferably 100 $\mu$S/cm or less, most preferably 60 $\mu$S/cm or less of the finally dehydrated salts. A lower limit of the conductivity is not particular limited, which may generally be about 5 $\mu$S/cm.

To improve conditions of coated surface of the thermally processed material, in particular, the photothermographic material, it is preferred that an aqueous dispersion of the silver salt of an organic acid is obtained, and then the dispersion is converted into a high-speed flow under a high-pressure, and then re-dispersed by lowering the pressure to form a fine aqueous dispersion of the salt. In this case, a medium for the dispersion is preferably water alone, however, the medium may contain an organic solvent in an amount of 20% by weight or less.

As methods for preparing fine dispersion of the silver salt of an organic acid, mechanical dispersing process in the presence of a dispersing aid may be applied by using known pulverizing means such as a high-speed mixer, a homogenizer, a high-speed impact mill, a Banbary mixer, a homomixer, a kneader, a ball mill, a vibrating ball mill, a planetary ball mill, an attriter, a sand mill, a bead mill, a colloid mill, a jet mill, a roller mill, a trone mill, and a high-speed stone mill.

It is desirable that the dispersing process may be carried out substantially in the absence of a photosensitive silver salt, since the presence of photosensitive silver salt during the dispersing process will increase fog and markedly lower sensitivity. According to the present invention, the amount of the photosensitive silver salt in the aqueous dispersion may be 0.1 mole % or less per mole of the silver salt of an organic acid, and the photosensitive silver salt should not be added intentionally.

For obtaining a uniform solid dispersion of a silver salt of an organic acid having a high S/N ratio and a small grain size and being free from coagulation, it is preferable to uniformly apply strong force so far that the force will not cause breakage or a temperature increase of grains of the silver salt of an organic acid as the image-forming media. For this purpose, a dispersing method is preferred which comprises the steps of converting an aqueous dispersion that contains a silver salt of an organic acid and an aqueous solution of dispersant into a high-speed flow, and then releasing the pressure.

The dispersing apparatuses and techniques used for performing the above-described re-dispersion method are described in detail, for example, in Toshio Kajiuchi and Hiromoto Usui, Bunsan-kei Rheology to Bunsanka Gijutsu (Rheology of Dispersion System and Dispersion Technology), pp.357–403, Shinzan Sha Shuppan (1991), and Kagaku Kogaku no Shinpo (Progress of Chemical Engineering), vol. 24, pp. 184–185, compiled by Corporation Kagaku Kogakukai Tokai Shibu, Maki Shoten (1990), JP-A-59-49832, U.S. Pat. No. 4,533,254, JP-A-8-137044, JP-A-8-238848, JP-A-2-261525, JP-A-1-94933 and the like. The re-dispersion method used in the present invention comprises the steps of supplying a water dispersion containing at least a silver salt of an organic acid into a pipeline under a positive pressure by means of a high-pressure pump or the like, passing the dispersion through a narrow slit provided inside the pipeline, and then subjecting the dispersion to rapid pressure release to perform fine dispersion.

As for the high-pressure homogenizer, it is generally considered that uniform dispersion can be efficiently achieved by increasing (a) "shear force" generated during the passage of a dispersoid through a narrow slit (approximately from 75 $\mu$m to 350 $\mu$m) under high pressure at a high speed and (b) "cavitation force" generated by the pressure releasing without changing the preceding impact force resulting from liquid-liquid collision or liquid-wall collision in the high-pressured narrow space. One old example of the dispersion apparatus of this type is a Golline homogenizer. In this apparatus, a liquid to be dispersed introduced under high pressure is converted into a high-speed flow in a narrow gap formed on the wall of a cylindrical surface. Then, the flow collides against a surrounding wall with its own energy, and is emulsified and dispersed by the impact force. Examples of apparatuses for the liquid-liquid collision mentioned above include, for example, a Y-type chamber of a microfluidizer, a spherical chamber utilizing a spherical check valve such as that described in JP-A-8-103642 mentioned below and the like. An example of an apparatus for the liquid-wall collision includes a Z-type chamber of microfluidizer and the like. The pressure applied is generally from 100 to 600 kg/cm$^2$, and the flow rate is generally a few meters/sec to 30 meters/sec. In order to increase dispersion efficiency, some apparatuses are designed wherein a high flow rate area is modified to have a serrated configuration, thereby the frequency of collision is increased. Typical examples of such devices are Golline homogenizer, Microfluidizer from Microfluidex International Corporation, Microfluidizer from Mizuho Kogyo Co., Ltd., Nanomizer from Tokushu Kika Kogyo Co., Ltd and the like. Other examples of such apparatuses are described in JP-A-8-238848, JP-A-8-103642 and U.S. Pat. No. 4,533,254.

The silver salt of an organic acid can be dispersed to have a desired grain size by controlling a flow rate, a difference in pressure achieved by pressure releasing and the frequency of processing. From viewpoints of photographic performance and the grain size, the flow rate is preferably from 200 to 600 m/sec and the difference in pressure at pressure releasing is preferably from 900 to 3,000 kg/cm$^2$, and more preferably, the flow rate is from 300 to 600 m/sec, and the difference in pressure at pressure releasing is from 1,500 to 3,000 kg/cm$^2$. The frequency of the dispersion processing may be appropriately chosen as required, and frequency of 1 to 10 times may generally be chosen. From a viewpoint of productivity, the frequency of approximately from 1 to 3 times is chosen. Warming of a water dispersion at a high temperature under a high pressure is not desired from viewpoints of dispersibility and photographic performance. At a high temperature above 90° C., a grain size may readily become large and fog may be increased. Accordingly, a cooling apparatus may preferably be provided in a step before the conversion into a high-pressure and high-speed flow, or a step after the pressure release, or both of the steps, and a temperature of the water dispersion is preferably kept by the cooling step at from 5° C. to 90° C., more preferably from 5° C. to 80° C., most preferably from 5° C. to 65° C. It is particularly effective to provide the cooling step when dispersing is carried out under a high pressure of from 1,500 to 3,000 kg/cm$^2$. The cooling apparatus may be appropriately selected from a double pipe or triple pipe provided with a static mixer, a multi-tubular exchanger, a coiled heat exchanger and the like depending on an amount of heat exchange to be required. The size, wall thickness or material of a pipe may be appropriately selected to increase heat exchange efficiency depending on an applied pressure. In addition, depending on an amount of heat exchange, a refrigerant used in the cooling apparatus may be a well water at 20° C. or a chilled water at from 5 to 10° C. cooled by a refrigerator, and if desired, a refrigerant such as ethylene glycol/water at −30° C. may also be used.

When the silver salt of an organic acid is subjected to fine solid dispersing process using a dispersing aid, synthetic anion polymers such as polyacrylic acid, acrylic acid copolymer, maleic acid copolymer, maleic acid monoester copolymer and acryloylmethylpropanesulfonic acid copolymer, semisynthetic anionic polymers such as carboxymethyl starch and carboxymethyl cellulose, anionic polymers such as alginic acid and pectic acid, anionic surfactants described in JP-A-52-92716, WO88/04794 and the like, the compounds described in JP-A-9-179243, known anionic, nonionic or cationic surface active agents, known polymers such as polyvinyl alcohol, polyvinylpyrrolidone, carboxymethyl cellulose, hydroxypropyl cellulose and hydroxypropylmethyl cellulose, and naturally-occurring polymer compounds such as gelatin may be appropriately chosen and used.

The dispersing aid is generally mixed with the silver salt of an organic acid in a form of powder or wet cake before the dispersing process, and fed as slurry into a dispersing apparatus. The dispersing aid may also be mixed with the silver salt of an organic acid beforehand to perform treatment such as by heating or with a solvent to form a silver salt of an organic acid in the form of powder or wet cake. A pH may be controlled by using a suitable pH modifier before, during or after the dispersing operation.

In addition to the mechanical dispersion, the silver salt of an organic acid can be made into fine grains by roughly dispersing the salt in a solvent through a pH control, and then changing the pH in the presence of a dispersing aid. For the operation, an organic solvent may be used as a solvent for the rough dispersion, and such organic solvent can be removed after the completion of the fine grain formation.

The dispersion prepared can be stored with stirring to prevent precipitation of the fine grains during storage, or stored in a highly viscous state formed by means of a hydrophilic colloids (e.g., a jelly state formed with gelatin). Furthermore, a preservative may be added to the dispersion to prevent proliferation of microorganisms during storage.

The silver salt of an organic acid prepared by the method for preparing silver salt of an organic acid is preferably dispersed in an aqueous solvent, and then mixed with an aqueous solution of a photosensitive silver salt to provide a coating solution for photosensitive image-forming media.

Before the dispersing process, the stock solution is preferably roughly dispersed (preparatory dispersion). As means for the rough dispersion, known dispersion means, for example, a high-speed mixer, a homogenizer, a high-speed impact mill, a Banbary mixer, a homomixer, a kneader, a ball mill, a vibrating ball mill, a planetary ball mill, an attriter, a sand mill, a bead mill, a colloid mill, a jet mill, a roller mill, a trone mill or a high-speed stone mill may be used. In addition to the mechanical dispersion, the stock solution may be roughly dispersed in a solvent by controlling pH, and then formed into fine grains in the presence of a dispersion aid by changing pH. For this process, an organic solvent may be used as the solvent used for the rough dispersion. The organic solvent is usually removed after the completion of the fine grain formation.

An aqueous photosensitive silver salt solution may be added after the preparation of the fine dispersion to produce a coating solution for photosensitive image-forming media. When the coating solution thus obtained is used for the preparation of a photothermographic material, a photothermographic material exhibiting low haze and low fog whereas having high sensitivity can be obtained. When a photosensitive silver salt is allowed to coexist at the time of the dispersing process by conversion under a high-pressure to a high-speed flow, fog will increase and sensitivity is significantly decreased. Furthermore, when an organic solvent is used as a dispersion medium instead of water, haze will increase, fog will increase, and sensitivity may likely be lowered. When a conversion method where a part of the silver salt of an organic acid in the dispersion is converted into a photosensitive silver salt is used instead of the method of mixing an aqueous photosensitive silver salt solution, sensitivity will be decreased.

The above-described water dispersion obtained by conversion under a high-pressure to high-speed flow contains substantially no photosensitive silver salt. The content thereof is 0.1 mole % or less based on the non-photosensitive silver salt of an organic acid, and the photosensitive silver salt may not be added intentionally.

The grain size (volume-weighted average diameter) in the solid fine grain dispersion of silver salt of an organic acid can be determined from a grain size (volume-weighted average diameter) determined by irradiating the solid fine grain dispersion dispersed in a liquid with a laser ray and determining an autocorrelation function of the scattered light on the basis of the change in time. The solid fine grain dispersion having an average grain size of from 0.05 to 10.0 $\mu$m is preferred. An average grain size of from 0.1 to 5.0 $\mu$m may be more preferred, and from 0.1 to 2.0 $\mu$m may be further preferred.

The silver salt of an organic acid solid fine grain dispersion preferably used in the present invention comprises at least a silver salt of an organic acid and water. The ratio of the silver salt of an organic acid to water is not particularly limited. The silver salt of an organic acid preferably accounts for from 5 to 50 weight %, more preferably from 10 to 30 weight % of the entire dispersion. The aforementioned dispersing aid may preferably be used, however, it is preferred that a minimum amount may be used within the range suitable for obtaining a minimum grain size. An amount of from 1 to 30 weight %, in particular, from 3 to 15 weight %, based on the silver salt of an organic acid may be preferred.

In the present invention, a photosensitive material may be produced by mixing a silver salt of an organic acid aqueous dispersion and a photosensitive silver salt aqueous dispersion. The mixing ratio of the silver salt of an organic acid and the photosensitive silver salt may be chosen depending on a purpose. The ratio of the photosensitive silver salt to the silver salt of an organic acid is preferably from 1 to 30 mole %, more preferably from 3 to 20 mole %, most preferably from 5 to 15 mole %. Two or more different aqueous dispersions of silver salt of an organic acid are preferably mixed with two or more different photosensitive silver salt aqueous dispersions, which method may be preferably applied to control photographic properties.

The silver salt of an organic acid may be used in any desired amount according to the present invention, and the amount may be from 0.1 to 5 g/m$^2$, more preferably from 1 to 3 g/m$^2$ as the weight of silver.

The photothermographic material of the invention contains a reducing agent for silver ions. The reducing agent for silver ions may be any substance capable of reducing silver ions into silver, preferably an organic substance. Some examples of the reducing agent are described in JP-A-11-65021, paragraphs 0043 to 0045 and EP 0803764A1, from page 7, line 34 to page 18, line 12. For the use in the present invention, bisphenol-type reducing agents (e.g., 1,1-bis(2-hydroxy-3,5-dimethylphenyl)-3,5,5-trimethylhexane) are particularly preferred. The amount of the reducing agent is preferably from 0.01 to 5.0 g/m$^2$, more preferably from 0.1 to 3.0 g/m$^2$. The amount of the reducing agent is preferably 5 to 50 mole %, more preferably 10 to 40 mole %, per mole of silver on the side of the image-forming layer. The reducing agent is preferably admixed in the image-forming layer.

The reducing agent used according to the present invention is preferably added in the form of a dispersion of solid microparticles. The microparticle dispersion of the reducing agent may be prepared by using any known pulverizing means, for example, ball mill, vibration ball mill, sand mill, colloid mill, jet mill, roller mill and the like. A dispersing aid may be used for the preparation of the solid microparticle dispersion.

In order to obtain ultrahigh contrast images for use as photomechanical process films, an ultrahigh contrast agent may be used according to the present invention. As the ultrahigh contrast agent, those of the general formulas (III) to (V) disclosed in the specification of Japanese Patent Application No. 11-91652, more specifically those described in [Formula 21] to [Formula 24] can be used. However, the ultrahigh contrast agent is not limited to these compounds.

The photosensitive silver halide which can be used for the present invention is not particularly limited as for halogen composition, and silver chloride, silver chlorobromide, silver bromide, silver iodobromide, and silver chloroiodobromide may be used. Distribution of the halogen composition may be uniform in the grains, or alternatively, the halogen composition may alter stepwise or continuously in the grains. Silver halide grains having a core/shell structure may preferably be used. A double to quintuple structure is preferred, and more preferably, core/shell grains having a double to quadruple structure may be used. A technique for localizing silver bromide on the surface of silver chloride or silver chlorobromide grains may also be preferably used.

Preparations of the photosensitive silver halide are well known in the art. For example, methods described in Research Disclosure, No. 17029 (June, 1978) and U.S. Pat. No. 3,700,458 can be used. More specifically, a method can be used which comprises the step of preparing photosensitive silver halide grains by addition of a silver-supplying compound and a halogen-supplying compound to a solution of gelatin or other polymer, and then adding a silver salt of an organic acid to the resulting grains.

The average grain size of the photosensitive silver halide is from 0.001 $\mu$m to 0.06 $\mu$m. Specifically, the average grain size may preferably be from 0.01 $\mu$m to 0.06 $\mu$m, preferably from 0.01 to 0.05 $\mu$m, more preferably from 0.02 to 0.04 $\mu$m. The term "grain size" used herein means a diameter of a sphere having the same volume as the grain where the silver halide grains are regular crystals in cubic or octahedral form and where the silver halide grains are irregular crystals such as spherical or rod-like grains. Where silver halide grains are tabular grains, the term means the diameter of a circle having the same area as a projected area of the main surface of the tabular grain.

Examples of the form of silver halide grains include a cubic form, octahedral form, tabular form, spherical form, rod-like form and potato-like form. In particular, cubic grains are preferred for the present invention. Silver halide grains having round corners are also preferably used in the present invention. Surface index (Miller index) of outer surfaces of the photosensitive silver halide grains is not particularly limited. However, it is desirable that [100] face be present in a high proportion that can achieve high spectral sensitizing efficiency when a spectral sensitizing dye adsorbs thereto. The proportion of [100] face may be preferably not lower than 50%, more preferably at least 65%, still more preferably at least 80%. The proportion of Miller index [100] face can be determined using the method described in T. Tani, J. Imaging Sci., 29, 165 (1985), where the difference in adsorption property of a sensitizing dye to [111] face and [100] face is utilized.

The photosensitive silver halide grain contains a metal or metal complex of Group VIII to Group X in the periodic table of elements (including Group I to Group XVIII). The metal or the center metal of the metal complex of Group VIII to X of the periodic table is preferably rhodium, rhenium, ruthenium, osmium or iridium. The metal complex may be used alone, or two or more complexes of the same or different metals may also be used in combination. The metal complex content is preferably from $1\times10^{-9}$ to $1\times10^{-3}$ mole per mole of silver. Such metal complexes are described in JP-A-11-65021, paragraphs 0018 to 0024.

In the present invention, an iridium compound is preferably contained in the silver halide grains. Examples of the iridium compound include hexachloroiridium, hexammineiridium, trioxalatoiridium, hexacyanoiridium and pentachloronitrosyliridium. The iridium compound is used after dissolving the compound in water or an appropriate solvent, and a method commonly used for stabilizing the iridium compound solution, more specifically, a method comprising adding an aqueous solution of hydrogen halogenide (e.g., hydrochloric acid, hydrobromic acid, hydrofluoric acid) or halogenated alkali (e.g., KCl, NaCl, KBr, NaBr) may be used. Instead of using a water-soluble iridium, different silver halide grains doped beforehand with iridium may be added and dissolved at the time of preparation of silver halide. The amount of the iridium compound is preferably $1\times10^{-8}$ to $1\times10^{-3}$ mole, more preferably $1\times10^{-7}$ to $5\times10^{-4}$ mole, per mole of silver halide.

Further, metal complexes that can be contained in the silver halide grains used for the present invention (e.g., $[Fe(CN)_6]^{4-}$), desalting methods and chemical sensitization methods are described in JP-A-11-84574, paragraphs 0046 to 0050 and JP-A-11-65021, paragraphs 0025 to 0031.

In the photothermographic material of the present invention, one kind of photosensitive silver halide emulsion may be used or two or more different emulsions (for example, those having different average grain sizes, different halogen compositions, different crystal habits or different chemical sensitization conditions) may be used in combination. By using plural photosensitive silver halides having different sensitivities, contrast can be controlled. Examples of the techniques in the art includes those mentioned in JP-A-57-119341, JP-A-53-106125, JP-A-47-3929, JP-A-48-55730, JP-A-46-5187, JP-A-50-73627, JP-A-57-150841 and the like. Each emulsion may preferably have sensitivity difference of 0.2 log E or higher.

The amount of the photosensitive silver halide is preferably 0.03 to 0.6 g/m$^2$, more preferably 0.05 to 0.4 g/m$^2$, most preferably 0.1 to 0.4 g/m$^2$, as the amount of coated silver per 1 m$^2$ of a photosensitive material. The amount of the photosensitive silver halide per mole of the silver salt of an organic acid is preferably from 0.01 to 0.5 mole, more preferably from 0.02 to 0.3 mole, still more preferably from 0.03 to 0.25 mole.

Methods and conditions for mixing photosensitive silver halide and a silver salt of an organic acid, which are prepared separately, are not particularly limited so long as the effect of the present invention can be attained satisfactorily. Examples include, for example, a method of mixing silver halide grains and a silver salt of an organic acid after completion of respective preparations by using a high-speed stirring machine, a ball mill, a sand mill, a colloid mill, a vibrating mill or a homogenizer or the like, or a method of preparing a silver salt of an organic acid by mixing a light-sensitive silver halide obtained separately at any time during the preparation of the silver salt of an organic acid.

Preferred time for addition of a silver halide to a coating solution for image-forming layer resides in a period of from 180 minutes before coating to just before coating, preferably 60 minutes to 10 seconds before coating. Methods and conditions for mixing are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and the like.

In the present invention, an image-forming layer is preferably formed by using an aqueous coating solution. As the aqueous coating solution, for example, a coating solution containing 30% by weight or more of water based on a total solvent may be used, and an image-forming layer can be formed by drying the coating solution after application. In this case, a binder for the image-forming layer may preferably be contained in the aqueous coating solution (an aqueous solvent) in a dissolved or dispersed state. In particular, a polymer latex having an equilibrated moisture content of 2 weight % or less at 25° C. and relative humidity of 60% is preferred. In the most preferred embodiment, the polymer latex is prepared to have an ion conductivity of 2.5 mS/cm or less. An example of a method for preparing such polymer latex includes a method comprising the step of synthesizing a polymer and then purifying the polymer by using a functional membrane for separation.

The aqueous solvent in which the polymer binder is soluble or dispersible is water or water mixed with 70% by weight or less of a water-miscible organic solvent. Examples of the water-miscible organic solvent include, for example, alcohols such as methyl alcohol, ethyl alcohol and propyl alcohol; cellosolves such as methyl cellosolve, ethyl cellosolve and butyl cellosolve; ethyl acetate, dimethylformamide and the like.

The term "aqueous solvent" used herein also encompasses systems in which a polymer is not thermodynamically dissolved but is present in a so-called dispersed state.

The definition "equilibrated moisture content at 25° C. and relative humidity of 60%" used herein can be represented by the following equation, in which W1 indicates the weight of a polymer at humidity-conditioned equilibrium at 25° C. and relative humidity of 60%, and WO indicates the absolute dry weight of the polymer at 25° C.

$$\text{Equilibrated moisture content at } 25^\circ \text{ C. and relative humidity of } 60\% = [(W1 - W0/W0] \times 100 \text{ (weight \%)}$$

As for details of the definition of moisture content and methods for measurement, for example, Lecture of Polymer Engineering, 14, Test Methods for Polymer Materials (Polymer Society of Japan, Chijin Shokan) can be referred to.

The equilibrated moisture content at 25° C. and relative humidity of 60% of the binder polymer used for the present invention is preferably 2% by weight or less, more preferably from 0.01 to 1.5% by weight, most preferably from 0.02 to 1% by weight.

In the present invention, polymers dispersible in aqueous solvents are particularly preferred.

Examples of systems in the dispersed state include, for example, a polymer latex in which fine solid particles of polymer are dispersed, and a system in which a polymer is dispersed in a molecular state or as micelles, both of which are preferred.

In preferred embodiments of the invention, hydrophobic polymers such as acrylic resins, polyester resins, rubber resins (e.g., SBR resins), polyurethane resins, polyvinyl chloride resins, polyvinyl acetate resins, polyvinylidene chloride resins, and polyolefin resins can preferably be used. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 200,000. Polymers having a too small molecular weight fails to give sufficient mechanical strength of an emulsion layer, and those having a too large molecular weight yields bad film forming property, and both of which are not preferred.

The "aqueous solvent" mentioned above means a dispersion medium of which composition comprises at least 30% by weight of water. As for a state of dispersion, systems in any state may be used, for example, emulsion dispersion, micellar dispersion, molecular dispersion of a polymer having a hydrophilic moiety in the molecule and the like. Among them, polymer latex is particularly preferred.

Preferred examples of the polymer latex are shown below. They are described as monomers as starting materials. The numerals parenthesized are indicated as % by weight, and the molecular weights are number average molecular weights.

P-1: Latex of—MMA(70)-EA(27)-MAA(3)—(molecular weight: 37000)

P-2: Latex of—MMA(70)-2EHA(20)-St(5)-AA(5)—(molecular weight: 40000)

P-3: Latex of—St(50)-Bu(47)-MMA(3)—(molecular weight: 45000)

P-4: Latex of—St(68)-Bu(29)-AA(3)—(molecular weight: 60000)

P-5: Latex of—St(70)-Bu(27)-IA(3)—(molecular weight: 120000)

P-6: Latex of—St(75)-Bu(24)-AA(1)—(molecular weight: 108000)

P-7: Latex of—St(60)-Bu(35)-DVB(3)-MAA(2)—(molecular weight: 150000)

P-8: Latex of—St(70)-Bu(25)-DVB(2)-AA(3)—(molecular weight: 280000)

P-9: Latex of—VC(50)-MMA(20)-EA(20)-AN(5)-AA(5)—(molecular weight: 80000)

P-10: Latex of—VDC(85)-MMA(5)-EA(5)-MAA(5)—(molecular weight: 67000)

P-11: Latex of—Et(90)-MAA(10)—(molecular weight: 12000)

P-12: Latex of—St(70)-2EHA(27)-AA(3)—(molecular weight: 130000)

P-13: Latex of—MMA(63)-EA(35)-AA(2)—(molecular weight: 33000)

Abbreviations in the above formula represents the following monomers:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride Et: ethylene
IA: itaconic acid The polymer latexes mentioned above are also commercially available, and those mentioned below can be used. Examples of acrylic resins include CEBIAN A-4635, 46583, 4601 (all from Daicel Chemical Industries), Nipol Lx8ll, 814, 821, 820, 857 (all from Nippon Zeon) and the like; examples of polyester resins include FINETEX ES650, 611, 675, 850 (all from Dai-Nippon Ink and Chemicals), WD-size, WMS (both from Eastman Chemical) and the like; examples of polyurethane resins include HYDRAN AP10, 20, 30, 40 (all from Dai-Nippon Ink and Chemicals) and the like; examples of rubber resins are LACSTAR 7310K, 3307B, 4700H, 7132C (all from Dai-Nippon Ink & Chemicals), Nipol Lx416, 410, 438C, 2507 (all from Nippon Zeon) and the like; examples of polyvinyl chloride resins include G351, G576 (both from Nippon Zeon) and the like; examples of polyvinylidene chloride resins are L502, L513 (both from Asahi Chemical Industry) and the like; examples of polyolefin resins include CHEMIPEARL S120, SA100 (both from Mitsui Petrochemical) and the like.

These polymer latexes may be used alone, or two or more of them may be blended as required.

As the polymer latex used in the present invention, styrene/butadiene copolymer latex is particularly preferred. In the styrene/butadiene copolymer, the weight ratio of styrene monomer units to butadiene monomer units is preferably 40/60 to 95/5. The ratio of the styrene monomer units and the butadiene monomer units in the copolymer may preferably be from 60 to 99% by weight. The preferred range of the molecular weight of the copolymer is similar to that mentioned above.

Examples of styrene/butadiene copolymer latexes preferably used for the present invention include the aforementioned P-3 to P-8, commercially available products, LACSTAR-3307B, 7132C, Nipol Lx416 and the like.

The layer containing silver salt of an organic acid of the photothermographic material of the present invention may optionally be added with a hydrophilic polymer such as gelatin, polyvinyl alcohol, methyl cellulose and hydroxypropyl cellulose. The amount of the hydrophilic polymer is preferably 30% by weight or less, more preferably 20% by weight or less, of the total binder in the layer containing silver salt of an organic acid.

The layer containing silver salt of an organic acid (i.e., the image-forming layer) of the photothermographic material of the present invention may preferably be those formed by using a polymer latex. The amount of the binder in the layer containing a silver salt of an organic acid may be 1/10 to 10/1, more preferably 1/5 as indicated by a weight ratio of a total binder/a silver salt of an organic acid.

The layer containing silver salt of an organic acid generally also serves as an image-forming layer (an emulsion layer) containing a photosensitive silver halide as a photosensitive silver salt. In that case, the weight ratio of a total binder/a silver halide may preferably be 5 to 400, more preferably 10 to 200.

The total amount of the binder in the image-forming layer of the photothermographic material of the present invention is preferably 0.2 to 30 g/m$^2$, more preferably 1 to 15 g/m$^2$. The image-forming layer may optionally be added with a crosslinking agent, a surfactant to improve coating property of a coating solution and the like.

The solvent for the coating solution for the layer containing silver salt of an organic acid of the photothermographic material of the present invention (for simplicity, a dispersion medium as well as a solvent is herein referred to as a "solvent") is an aqueous solvent containing at least 30% by weight of water. As components other than water, any water-miscible organic solvents may be used such as, for example, methyl alcohol, ethyl alcohol, isopropyl alcohol, methyl cellosolve, ethyl cellosolve, dimethylformamide, ethyl acetate and the like. The water content of the solvent for the coating solution is preferably at least 50% by weight, more preferably at least 70% by weight. Preferred examples of the solvent composition include water/methyl alcohol=90/10, water/methyl alcohol=70/30, water/methyl alcohol/dimethylformamide=80/15/5, water/methyl alcohol/ethyl cellosolve=80/10/5, water/methyl alcohol/isopropyl alcohol=85/10/5, as well as water (numerals indicate weight %).

As a sensitizing dye that can be used for the present invention, such sensitizing dyes may advantageously be chosen which can spectrally sensitize silver halide grains within a desired wavelength range after they are adsorbed by the silver halide grains and have spectral sensitivity suitable for spectral characteristics of a light source for exposure. Sensitizing dyes and methods for addition of the dye are described in JP-A-11-65021, paragraphs 0103 to 0109; JP-A10-186572, compounds of formula (II); and EP 0803764A1, page 19, line 38 to page 20, line 35. A time to add the sensitizing dye to the silver halide emulsion may preferably be during the period after the desalting step and before coating, more preferably during the period after the desalting step and before the start of the chemical ripening.

Examples of antifoggants, stabilizers, and stabilizer precursors that can be used for the present invention include, for example, those mentioned in JP-A-10-62899, paragraph 0070 and EP 0803764A1, from page 20, line 57 to page 21, line 7.

The antifoggant is preferably added in the form of a solid microparticle dispersion in the present invention. The solid microparticle dispersion is performed by using a known pulverizing means such as a ball mill, a vibration ball mill, a sand mill, a colloid mill, a jet mill, a roller mill. For preparation the solid microparticle dispersion, a dispersing aid such as anionic surfactant (e.g., sodium triisopropylnaphthalenesulfonate as a mixture of those having three isopropyl groups at different positions) may be used.

Other examples of the antifoggant include the mercury(II) salts described in JP-A-11-65021, paragraph 0113 and the benzoic acids described in the same, paragraph 0114.

The photothermographic material of the present invention may contain an azolium salt as the antifoggant. Examples of the azolium salt include, for example, the compounds of the formula (XI) described in JP-A-59-193447, the compounds described in JP-B-55-12581 and the compounds of the formula (II) described in JP-A-60-153039. The azolium salt may be added in any site of the photothermographic material, and is preferably added in one or more layers on the side of an image-forming layer, more preferably in the layer containing silver salt of an organic acid. The azolium salt may be added at any time during the preparation of the coating solution. When the azolium salt is added to the layer containing silver salt of an organic acid, the azolium salt may be added at any time during the period of from the preparation of the silver salt of an organic acid to the preparation of the coating solution. A time during the period after the preparation of the silver salt of an organic acid and just before coating. The azolium salt may be added as any form such as powder, a solution, and a microparticle dispersion. The salt may also be added as a solution prepared by mixing the salt with other additives such as a sensitizing dye, a reducing agent, and a color tone adjuster. In the present invention, the amount of the azolium salt to be added is not particularly limited, and the amount may preferably be $1\times10^{-6}$ mole to 2 moles, more preferably $1\times10^{-3}$ mole to 0.5 mole, per mole of silver.

The photothermographic material of the invention may optionally contain a mercapto compound, a disulfide compound, and a thione compound to accelerate, suppress, or control development, or increase efficiency in spectral sensitivity, or to improve storability before and after development. Examples include, for example, those described in JP-A-10-62899, paragraphs 0067 to 0069, compounds of the formula (I) and specific examples in the paragraphs 0033 to 0052 of JP-A-10-186572, and those described in EP 0803764A1, page 20, lines 36 to 56. Among them, heteroaromatic mercapto compounds and heteroaromatic disulfide compounds are preferred.

The heteroaromatic mercapto compounds and the heteroaromatic disulfide compounds can serve as ultrahigh sensitizing agents. Structures of the heteroaromatic mercapto compound are not particularly limited so far that the compounds have a heteroaromatic ring and a mercapto group. Those represented by Ar—SM may preferably be used. Structures of the heteroaromatic disulfide compounds are not particularly limited so far that the compounds have a heteroaromatic ring and a mercapto group. Those represented by Ar—S—S—Ar may preferably be used.

In the formulas Ar—SM and Ar—S—S—Ar, M represents hydrogen atom or an alkali metal atom, Ar represents an aromatic ring or a condensed aromatic ring containing at least one nitrogen atom, sulfur atom, oxygen atom, selenium atom, or tellurium atom. Preferably, heteroaromatic ring may be benzimidazole, naphthoimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline, or quinazolinone. The aforementioned heteroaromatic rings may be substituted by a functional group selected from the group consisting of a halogen atom (e.g., bromine or chlorine), hydroxy group, amino group, carboxy group, an alkyl group (preferably those having 1 to 4 carbon atoms), an alkoxy group (preferably those having 1 to 4 carbon atoms) and an aryl group which may optionally be substituted.

Examples of the heteroaromatic mercapto compounds include, for example, 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-(benzothiazole), 3-mercapto-1,2,4-triazole, 4,5-diphenyl-2-imidazole thiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinoline thiol, 2,3,5,6-tetrachloro-4-pyridine thiol, 4-amino-6-hydroxy-2-mercaptopyridine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)-benzenesulfonate, N-methyl-N'-[3-(5-mercaptotetrazoryl)phenyl]urea, 2-mercapto-4-phenyloxazole and the like. However, the heteroaromatic mercapto compounds which may be used in the present invention are not limited to these examples.

In the photothermographic material of the present invention, either of the heteroaromatic mercapto compound or the heteroaromatic disulfide compound may be used, or alternatively, both of them may be used. As each of the heteroaromatic mercapto compound or the heteroaromatic disulfide compound, a single compound may be used, or two or more compounds may be used in combination.

In order to obtain desired effects as ultrahigh sensitizing agents, total amount of the heteroaromatic mercapto compound or the heteroaromatic disulfide compound may preferably be within the range of from 0.001 to 1 mole, and more preferably 0.003 to 0.1 mole, per 1 mole of silver in an image forming layer wherein one mole of silver means one mole of silver halide.

In the present invention, it is preferable to add a toning agent. Examples of the toning agent are described in JP-A-10-62899, paragraphs 0054 to 0055 and EP 0803764A1, page 21, lines 23 to 48. Preferred examples include phthalazinone, phthalazinone derivatives (e.g., 4-(1-naphthyl)phthalazinone, 6-chlorophthalazinone, 5,7-dimethoxyphthalazinone, 2,3-dihydro-1,4-phthalazinone and other derivatives) and metal salts thereof; combinations of phthalazinones and phthalic acid or derivatives thereof (e.g., phthalic acid, 4-methylphthalic acid, 4-nitrophthalic acid, tetrachlorophthalic anhydride and the like); phthalazines including phthalazine and phthalazine derivatives (e.g., 4-(1-naphthyl)phthalazine, 6-isopropylphthalazine, 6-t-butylphthalazine, 6-chlorophthalazine, 5,7-dimethoxyphthalazine, 2,3-dihydrophthalazine and other derivatives) and metal salts thereof; combinations of phthalazines and phthalic acid or derivatives thereof (e.g., phthalic acid, 4-methylphthalic acid, 4-nitrophthalic acid, tetrachlorophthalic anhydride and the like). Particularly preferred examples include the combinations of phthalazines and phthalic acid or derivatives thereof.

Plasticizers and lubricants that can be used for the image-forming layer of the photothermographic material of the present invention are described in JP-A-11-65021, paragraph 0117. Ultrahigh contrast agents for forming ultrahigh contrast images are described in the same publication in paragraph 0118; and hardness enhancement promoters are described in the same publication in paragraph 0102.

The photothermographic material of the present invention may be provided with a surface protective layer, for example, to prevent adhesion of the image-forming layer. The surface protective layer is described in, for example, JP-A-11-65021, paragraphs 0119 to 0120.

Gelatin is preferred as the binder in the surface protective layer of the photothermographic material of the present invention, and polyvinyl alcohol (PVA) is also preferably used. Examples of PVA includes, for example, completely saponified PVA-105 [having a polyvinyl alcohol (PVA) content of at least 94.0% by weight, a degree of saponification of 98.5±0.5 mole %, a sodium acetate content of 1.5% by weight or less, a volatile content of 5.0% by weight or less, a viscosity (4% by weight at 20° C.) of 5.6±0.4 CPS]; partially saponified PVA-205 [having a PVA content of 94.0% by weight, a degree of saponification of 88.0±1.5 mole %, a sodium acetate content of 1.0% by weight, a volatile content of 5.0% by weight, a viscosity (4% by weight at 20° C.) of 5.0±0.4 CPS]; modified polyvinyl alcohols, MP-102, MP-202, MP-203, R-1130, R2105 (all from Kraray) and the like. The application amount of the polyvinyl alcohol (per $m^2$ of the support) for protective layers is preferably 0.3 to 4.0 $g/m^2$, more preferably 0.3 to 2.0 $g/m^2$ (per one layer).

The temperature for preparation of the coating solution for the image-forming layer used in the present invention may preferably be 30° C. to 65° C., more preferably 35° C.

to 60° C., most preferably 35° C. to 55° C. The temperature of the coating solution immediately after the addition of the polymer latex may preferably be kept at 30° C. to 65° C. A reducing agent and a silver salt of an organic acid may preferably be mixed before the addition of polymer latex.

The liquid containing a silver salt of an organic acid or the coating solution for a thermographic image-forming layer may preferably be a so-called thixotropic flow. Thixotropy means that viscosity of a fluid lowers with increase of shear rate. Any apparatus may be used for measurement of viscosity, and for example, RFS Fluid Spectrometer from Rheometrics Far East Co., Ltd. is preferably used and the measurement is performed at 25° C. A viscosity of the liquid containing a silver salt of an organic acid or the coating solution for a photothermographic image-forming layer may preferably be 400 mPa·s to 100,000 mPa·s, more preferably 500 mPa·s to 20,000 mPa·s, at a shear rate of 0.1 $sec^{-1}$. The viscosity is preferably 1 mPa·s to 200 mPa·s, more preferably 5 mPa·s to 80 mPa·s, at a shear rate of 1000 $sec^{-1}$.

Various systems exhibiting thixotropic property are known and, for example, described in "Lecture on Rheology", Kobunshi Kanko Kai; Muroi & Morino, "Polymer Latex", Kobunshi Knako Kai and the like. A fluid is required to contain a large amount of fine solid microparticles to exhibit thixotropic property. For enhancing thixotropic property, it is effective that the fluids is added with a viscosity-increasing linear polymer, or fine solid microparticles to be contained have anisotropic shapes and an increased aspect ratio. Use of an alkaline viscosity-increasing agent or a surfactant is also effective for that purpose.

The photothermographic emulsion layer used in the present invention is formed as one or more layers on the support. When the layer is monolayer, the layer contain a silver salt of an organic acid, a silver halide, a developing agent and a binder, as well as optional additional materials such as a color tone adjuster, a coating aid and other auxiliary agents. When the layer is bilayer, the first emulsion layer (in general, the layer adjacent to the support) contains a silver salt of an organic acid and a silver halide, and the second emulsion layer or said two layers contain the other ingredients. Another type of bilayer structure is also employable in which one layer is a single emulsion layer containing all necessary ingredients and the other layer is a protective top coat layer. Multicolor photothermographic material may contain these two layers for each color, or may contain all necessary ingredients in a single layer as described in U.S. Pat. No. 4,708,928. As for multicolor photothermographic materials containing multiple dyes, each emulsion layers are kept individually by using a functional or non-functional barrier layer between the adjacent image-forming layers as described in U.S. Pat. No. 4,460,681.

In the image-forming layer of the photothermographic material of the present invention, various types of dyes and pigments may be used to improve color tone, to prevent interference fringes generated during laser exposure, and to prevent irradiation. These techniques are detailed in WO98/36322. Preferred dyes and pigments for the image-forming layer include, for example, anthraquinone dyes, azomethine dyes, indoaniline dyes, azo dyes, indanthrone pigments of anthraquinone type (e.g., C.I. Pigment Blue 60 and the like), phthalocyanine pigments (e.g., copper phthalocyanines such as C.I. Pigment Blue 15; metal-free phthalocyanines such as C.I. Pigment Blue 16), triarylcarbonyl pigments of printing lake pigment type, indigo, inorganic pigments (e.g., ultramarine, cobalt blue and the like). Any methods are employed to add these dyes and pigments such as addition as a solution, an emulsion, or a dispersion of fine solid microparticles, or addition of those mordanted by using a polymer mordant. The amount of these compounds to be used may vary depending on intended absorbance. Generally, the compounds may preferably be in an amount of 1 $\mu$g to 1 g per $m^2$ of the photothermographic material.

In the photothermographic material of the invention, an antihalation layer may be provided in a distant position from a light source relative to the image-forming layer. The antihalation layer are described in JP-A-11-65021, paragraphs 0123 to 0124.

In the present invention, a decoloring dye and a base precursor are preferably added to a non-image-forming layer (non-photosensitive layer) of the photothermo-graphic material so that the non-image-forming layer can function as a filter layer or an antihalation layer. Photothermographic materials generally have non-image-forming layers in addition to the image-forming layers. Depending on their positions, the non-image-forming layers are classified into (1) a protective layer to be provided on an image-forming layer (the opposite side of the support); (2) an intermediate layer to be provided between two or more of image-forming layers or between an image-forming layer and a protective layer; (3) an undercoat layer to be provided between an image-forming layer and a support; (4) a backing layer to be provided on a side opposite to the image-forming layer. The filter layer is provided in the photosensitive material as the layer (1) or (2). The antihalation layer is provided in the photosensitive material as the layer (3) or (4).

The decoloring dye and the base precursor are preferably added to the same non-image-forming layer. They may be also added separately to adjacent two non-image-forming layers. If desired, a barrier layer may be provided between the two light non-image-forming layers.

As methods to add a decoloring dye to a non-image-forming layer, a method may be employed which comprises step of adding a solution, an emulsion, a solid microparticles dispersion of the dye, or the dye impregnated with a polymer to a coating solution for the non-image-forming layer. The dye may also be added to the non-image-forming layer by using a polymer mordant. These methods for addition are the same as those generally employed for the addition of dyes to ordinary photothermographic materials. Polymer latexes used for preparation of the dye impregnated with a polymer are described in U.S. Pat. No. 4,199,363, German Patent Laid-open Nos. 25,141,274, 2,541,230, EP-A-029104, and JP-B-53-41091. A method for emulsification by adding a dye to a solution in which a polymer is dissolved is described in International Patent Publication WO88/00723.

The amount of the decoloring dye may be determined depending on purpose of the use of the dye. In general, the dye is used in an amount to give an optical density (absorbance) of larger than 1.0 measured at an intended wavelength. The optical density is preferably 0.2 to 2. The amount of the dye to give such optical density may be generally from about 0.001 to about 1 $g/m^2$, preferably from about 0.005 to about 0.8 $g/m^2$, most preferably from about 0.01 to about 0.2 $g/m^2$.

Decoloring of dyes in that manner can lower optical density of the material to 0.1 or less. Two or more different decoloring dyes may be used in the thermodecoloring type recording materials or photothermographic materials. Similarly, two or more different base precursors may be used in combination.

The photothermographic material of the present invention is preferably a so-called single-sided photosensitive material comprising at least one image-forming layer containing a silver halide emulsion on one side of support, and a backing layer on the other side.

The photothermographic material of the present invention may preferably contain a matting agent for improving the transferability of the material. Matting agents are described in JP-A-11-65021, paragraphs 0126 to 0127. The matting agent is added in an amount of preferably 1 to 400 mg/m$^2$, more preferably 5 to 300 mg/m$^2$ as the amount per 1 m$^2$ of the photosensitive material.

The matting degree of the surface of the emulsion layer is not particularly limited so long as the material is free from stardust defects. Beck's smoothness of the matted surface is preferably 50 seconds to 10000 seconds, more preferably 80 seconds to 10000 seconds.

The matting degree of the backing layer in the present invention is preferably falls 10 seconds to 1200 seconds, more preferably 30 seconds to 700 seconds, most preferably 50 seconds to 500 seconds as shown by the Beck's smoothness.

The matting agent may preferably be contained in the outermost surface layer, or in a layer functioning as an outermost surface layer, or in a layer near to the outer surface of the photosensitive material. The agent may also be preferably contained in a layer functioning as a protective layer.

The backing layers that are applicable to the present invention are described in JP-A-11-65021, paragraphs 0128 to 0130.

A hardening agent may be added to the image-forming layer, the protective layer, the backing layer, and other layers of the photothermographic material of the present invention. Examples of the hardening agent are described in T. H. James, "THE THEORY OF THE PHOTOGRAPHIC PROCESS, FOURTH EDITION", Macmillan Publishing Co., Inc., 1977, pp. 77–87. Polyvalent metal ions described on page 78 of the above article, polyisocyanates described in U.S. Pat. No. 4,281,060 and JP-A-6-208193; epoxy compounds described in U.S. Pat. No. 4,791,042; vinylsulfone compounds described in JP-A-62-89048 and the like may preferably be used.

The hardening agent is added to coating solutions as a solution. Preferred addition time of the solution to the coating solution of the protective layer resides in a period of from 180 minutes before the coating to just before the coating, preferably 60 minutes to 10 seconds before the coating. The method and conditions for mixing are not particularly limited as far that the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and the like.

Surfactants that can be used in the photothermographic material of the invention are described in JP-A-11-65021, paragraph 0132; usable solvents are described in the above patent document in paragraph 0133; usable supports are described in the above patent document in paragraph 0134; usable antistatic and electroconductive layers are described in the above patent document in paragraph 0135; and usable methods for forming color images are described in the above patent document in paragraph 0136.

A transparent support for the photothermographic material of the present invention may be colored with a blue dye (e.g., with Dye-1 described in Examples of JP-A-8-240877) or may be colorless. Techniques for undercoating the support are described in JP-A-11-84574, JP-A-10-186565 and the like.

The photothermographic material of the invention is preferably a monosheet type material, wherein the monosheet uses no additional sheet as required by image receiving materials, and can form images directly on the material itself.

The photothermographic material of the present invention may further contain an antioxidant, a stabilizer, a plasticizer, a ultraviolet absorber or a coating aid. Such additives may be added to any of image-forming layers or non-image-forming layers. For these additives, WO98/36322, EP803764A1, JP-A-10-186567, JP-A-10-18568 and the like may be referred to.

Any coating methods may be employed for the preparation of the photothermographic material of the present invention. Specific examples thereof include various types of coating techniques, for example, extrusion coating, slide coating, curtain coating, dip coating, knife coating, flow coating, extrusion coating utilizing a hopper of the type described in U.S. Pat. No. 2,681,294 and the like. Preferred examples include extrusion coating and slide coating described in Stephen F. Kistler, Petert M. Schweizer, "LIQUID FILM COATING", published by CHAPMAN & HALL Co., Ltd., 1997, pp.399–536, and a most preferable example includes the slide coating. An example of the shape of a slide coater used for the slide coating is shown in FIG. 11*b,* 1 on page 427 of the aforementioned reference. If desired, two or more layers may be formed at the same time, for example, according to the methods described from page 399 to page 536 of the aforementioned reference, or the methods described in U.S. Pat. No. 2,761,791 and British Pat. No. 837,095.

Other techniques that can be used for the photothermographic material of the present invention are also described in EP803764A1, EP883022A1, WO98/36322, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574 and JP-A-11-65021.

The photothermographic material of the invention may be developed in any manner. Usually, an imagewise exposed photothermographic material is developed by heating. The temperature for the development is preferably 80° C. to 250° C., more preferably 100° C. to 140° C. The development time is preferably 1 to 180 seconds, more preferably 10 to 90 seconds, most preferably 10 to 40 seconds.

For thermal development for the material, a plate heater system is preferred. For heat development by the plate heater system, the method described in JP-A-11-133572 is preferred, which uses a heat development apparatus wherein a photothermographic material on which a latent image is formed is brought into contact with a heating means in a heat development section to obtain a visible image, and wherein the heating means comprises a plate heater, and a plurality of presser rollers are disposed facing to one surface of the plate heater, and wherein heat development of the photothermographic material is attained by passing the material between the presser rollers and the plate heater. The plate heater is preferably sectioned into 2 to 6 stages, and the temperature of the top stage is preferably kept lower by approximately 1 to 10° C. than that of the others stages. Such a method is also described in JP-A-54-30032. The plate heater system can remove moisture and organic solvent contained in the photothermographic material out of the material, and prevent change in shape of the support of the photothermographic material by rapid heating of the material.

The photothermographic material of the present invention can be exposed by any means. As light source of exposure, laser rays are preferred. As the laser used in the present invention, gas lasers ($Ar^+$, He—Ne), YAG lasers, dye lasers, semiconductor lasers and the like are preferred. A combination of semiconductor laser and second harmonic generating device may also be used. Preferred examples include gas and semiconductor lasers for red to infrared emission.

Single mode lasers can be used as the laser rays, and the technique disclosed in JP-A-11-65021, paragraph 0140 can be used.

The laser output is preferably at least 1 mW, more preferably at least 10 mW. Even more preferred is high output of at least 40 mW. If desired, a plurality of lasers may be combined. The diameter of a laser beam may be between about 30 and 200 $\mu$m based on the level of $1/e^2$ spot size of a Gaussian beam.

The photothermographic materials of the invention form a monochromatic image based on silver image, and are preferably used as photothermographic materials for use in medical diagnosis, industrial photography, printing and COM. It should be understood that, in such applications, the monochromatic images formed can be duplicated on duplicating films, MI-Dup, from Fuji Photo Film for medical diagnosis; and for printing, the images can be used as a mask for forming reverse images on printing films such as DO-175 and PDO-100 from Fuji Photo Film, or on offset printing plates.

EXAMPLES

The present invention will be specifically explained with reference to the following preparation examples and working examples. The materials, regents, ratios, procedures and so forth shown in the following examples can be optionally changed so long as such change does not depart from the spirit of the present invention. Therefore, the scope of the present invention is not limited to the following examples.

Preparation Example 1

Synthesis of Exemplary Compound (P-69)

(1) Synthesis of Intermediate Compound (B)

The readily available Compound (A) (93 g), sodium hydroxide (43 g), sodium chloroacetate (123 g) and potassium iodide (10 g) were dissolved in water (300 ml), and stirred at 80° C. for 2 hours. After the internal temperature was lowered to 30° C., the solution was added with concentrated hydrochloric acid (50 ml). After the reaction mixture was stirred for a while, crystals were deposited. The crystals were collected by suction filtration and dried. As a result, 50 g of Intermediate Compound (B) was obtained as white crystals.

(2) Synthesis of Intermediate Compound (C)

To a solution of NaOH (57 g) dissolved in water (500 ml), bromine (33 ml) was added dropwise at room temperature, and then an aqueous solution of Intermediate Compound (B) (24 g) and NaOH (8 g) in water (100 ml) was added dropwise at room temperature. The deposited crystals were collected by filtration, and the obtained crystals were added to diluted hydrochloric acid, stirred and collected by filtration. The crystals were fully washed with water and dried. As a result, 30 g of Intermediate Compound (C) was obtained as white crystals.

(3) Synthesis of Intermediate Compound (D)

The Intermediate Compound (C) (30 g) and DMF (1 ml) were dissolved in thionyl chloride (100 ml) and stirred at 70° C. for 30 minutes. Then, excessive thionyl chloride was evaporated under reduced pressure. As a result, 31 g of Intermediate Compound (D) was obtained as white crystals.

(4) Synthesis of Exemplary Compound (P-69)

A solution of octylamine (8.0 g) in methanol (50 ml) was cooled on ice, and added with Intermediate Compound (D) (4.0 g). After the mixture was stirred for 10 minutes at room temperature, 50 ml of diluted hydrochloric acid was added to the mixture. As a result, white crystals were deposited. The crystals were collected by filtration, fully washed with water and dried to obtain 3.0 g of Exemplary Compound (P-69) as white crystals (yield: 62%).

Preparation Example 2

Synthesis of Exemplary Compound (P-24)

3.5 g of Exemplary Compound (P-24) was obtained as white crystals (yield: 81%) in the same manner as that of Preparation Example 1 except that the octylamine was replaced with an equimolar amount of butylamine.

Preparation Example 3

Synthesis of Exemplary Compound (P-27)

A solution of 4-aminobutanoic acid (15 g) and sodium hydrogencarbonate (17 g) dissolved in a mixed solvent of water (100 ml) and tetrahydrofuran (100 ml) was added with Intermediate Compound (D) (20 g) and stirred for 5 minutes at room temperature. The reaction mixture was neutralized by addition of diluted hydrochloric acid and added with water (200 ml). The deposited crystals were collected by filtration and dried. 10 g of Exemplary Compound (P-27) was obtained as white crystals (yield: 44%).

Preparation Example 4

Synthesis of Exemplary Compound (P-12)

13 g of Exemplary Compound (P-12) was obtained as white crystals (yield: 60%) in the same manner as that of Preparation Example 3 except that the 4-aminobutanoic acid was replaced with an equimolar amount of glycine.

Preparation Example 5

Synthesis of Exemplary Compound (P-35)

3.7 g of Exemplary Compound (P-35) was obtained as white crystals (yield: 79%) in the same manner as that of Preparation Example 1 except that the octylamine was replaced with an equimolar amount of 6-amino-1-hexanol.

Preparation Example 6

Synthesis of Exemplary Compound (P-64)

3.7 g of Exemplary Compound (P-64) was obtained as white crystals (yield: 84%) in the same manner as that of Preparation Example 1 except that the octylamine was replaced with an equimolar amount of pentylamine.

Preparation Example 7

Synthesis of Exemplary Compound (P-70)

3.0 g of Exemplary Compound (P-70) was obtained as white crystals in the same manner as that of Preparation Example 1 except that the octylamine was replaced with an equimolar amount of diethylamine.

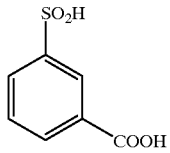

Compound (A)

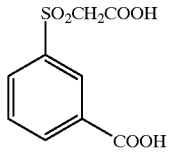

Intermediate Compound (B)

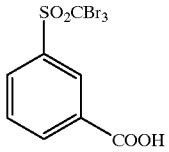

Intermediate Compound (C)

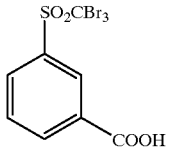

Intermediate Compound (D)

Example 1

Preparation of Photothermographic Material (Preparation of PET Support)

Using terephthalic acid and ethylene glycol, PET having an intrinsic viscosity IV of 0.66 (measured in phenol/tetrachloroethane=6/4 (weight ratio) at 25° C.) was obtained in a conventional manner. The PET was pelletized, and the pellets were dried at 130° C. for 4 hours, melted at 300° C., extruded from a T-die, and quenched to prepare an unstretched film having such a thickness that the film thickness after thermal fixation became 175 μm.

The film was stretched along the longitudinal direction by 3.3 times using rollers having different peripheral speeds and then stretched along the transverse direction by 4.5 times using a tenter. In these procedures, the temperatures were 110° C. and 130° C., respectively. The film was then subjected to thermal fixation at 240° C. for 20 seconds and relaxed by 4% along the transverse direction at the same temperature. Then, after chucks of the tenter were released, the both edges of the film were knurled, and the film was rolled up at 4 kg/cm$^2$ to provide a roll of the film having a thickness of 175 μm.

(Surface Corona Discharging Treatment)

Using a solid state corona discharging treatment machine Model 6KVA manufactured by Piller Inc., both surfaces of the support were treated at room temperature at 20 m/minute. From the read out values of the electric current and voltage, it was seen that the treatment of 0.375 kV·A·minute/m$^2$ was applied to the support. The treated frequency was 9.6 kHz and the gap clearance between the electrode and the dielectric roll was 1.6 mm.

(Preparation of Undercoated Support)

(1) Preparation of Coating Solution for Undercoat Layer

| | |
|---|---|
| Formulation 1 (for undercoat layer on image-forming layer side) | |
| Pesresin A-515GB made by Takamatsu Yushi K.K. (30% by weight solution) | 234 g |
| Polyethylene glycol monononylphenyl ether (mean ethylene oxide number = 8.5, 10% by weight solution) | 21.5 g |
| MP-1000 made by Soken Kagaku K.K. (polymer microparticles, mean particle size: 0.4 m) | 0.91 g |
| Distilled water | 744 ml |
| Formulation 2 (for 1st layer on back surface) | |
| Butadiene-styrene copolymer latex (solid content: 40% by weight, weight ratio of butadiene/styrene = 32/68) | 158 g |
| 2,4-Dichloro-6-hydroxy-S-triazine sodium salt (8% by weight aqueous solution) | 20 g |
| 1% by weight Aqueous solution of sodium laurylbenzenesulfonate | 10 ml |
| Distilled water | 854 ml |
| Formulation 3 (for 2nd layer on back surface side) | |
| $SnO_2$/SbO (weight ratio: 9/1, mean particle size: 0.038 μm 17% by weight dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1% by weight Aqueous solution of sodium dodecylbenzenesulfonate | 10 ml |
| NaOH (1%) | 6 ml |
| Proxel (made by ICI Co.) | 1 ml |
| Distilled water | 805 ml |

(Preparation of Undercoated Support)

After the aforementioned corona discharging treatment was applied to both surfaces of the aforementioned biaxially stretched polyethylene terephthalate support having a thickness of 175 μm, one surface (the side on which photosensitive layer is provided) was coated with the undercoating solution of Formulation 1 by using a wire bar in a wet coating amount of 6.6 ml/m$^2$ (per one surface) and dried at 180° C. for 5 minutes. Then, the back surface was coated with the undercoating solution of Formulation 2 by using a wire bar in a wet coating amount of 5.7 mI/M$^2$ and dried at 180° C. for 5 minutes. Further, the back surface thus coated was coated with the undercoating solution of Formulation 3 by using a wire bar in a wet coating amount of 7.7 ml/m$^2$ and dried at 180° C. for 6 minutes to prepare an undercoated support.

3(Preparation of Coating Solution for Back Surface)

(Preparation of Solid Microparticle Dispersion (a) of Base Precursor)

64 g of Base precursor compound 11, 28 g of diphenylsulfone and 10 g of a surface active agent, Demor N (manufactured by Kao Corporation), were mixed with 220 ml of distilled water, and the mixture was beads-dispersed using a sand mill (1/4 Gallon Sand Grinder Mill, manufactured by Imex Co.) to obtain Solid microparticle dispersion (a) of the base precursor compound having a mean particle size of 0.2 μm.

(Preparation of Dye Solid Microparticle Dispersion)

9.6 g of Cyanine dye compound 13 and 5.8 g of sodium p-dodecylbenzenesulfonate were mixed with 305 ml of distilled water and the mixture was beads-dispersed using a sand mill (1/4 Gallon Sand Grinder Mill, manufactured by Imex Co.) to obtain a dye solid microparticle dispersion having a mean particle size of 0.2 μm.

(Preparation of Coating Solution for Antihalation Layer)

17 g of gelatin, 9.6 g of polyacrylamide, 70 g of the aforementioned Solid microparticle dispersion (a) of the base precursor, 56 g of the aforementioned dye solid microparticle dispersion, 1.5 g of polymethyl methacrylate microparticles (mean particle size 6.5 μm), 0.03 g of benzoisothiazolinone, 2.2 g of sodium polyethylenesulfonate, 0.2 g of Blue dye compound 14 and 844 ml of water were mixed to prepare a coating solution for antihalation layer.

(Preparation of Coating Solution for Back Surface Protective Layer)

In a container kept at 40° C., 50 g of gelatin, 0.2 g of sodium polystyrenesulfonate, 2.4 g of N,N-ethylenebis (vinylsulfonacetamide), 1 g of sodium t-octylphenoxyethoxyethanesulfonate, 30 mg of benzoisothiazolinone, 37 mg of N-perfluorooctylsulfonyl-N-propylalanine potassium salt, 0.15 g of polyethyleneglycol mono-(N-perfluorooctylsulfonyl-N-propyl-2-aminoethyl) ether [average polymerization degree of ethylene oxide: 15], 32 mg of $C_8F_{17}SO_3K$, 64 mg of $C_8F_{17}SO_2N(C_3H_7)(CH_2CH_2O)_4(CH_2)_4—SO_3Na$, 8.8 g of an acrylic acid/ethyl acrylat copolymer (copolymerization ratio (by weight): 5/95), 0.6 g of Aerosol OT (manufactured by American Cyanamid Company), 1.8 g (as liquid paraffin) of a liquid paraffin emulsion and 950 ml of water were mixed to form a coating solution for a back surface protective layer.

(Preparation of Silver Halide Emulsion 1)

1421 ml of distilled water was added with 8.0 ml of a 1% by weight potassium bromide solution, and further added with 8.2 ml of 1 mol/L nitric acid and 20 g of phthalized gelatin. Separately, Solution A was prepared by adding distilled water to 37.04 g of silver nitrate for dilution to 159 ml, and Solution B was prepared by diluting 32.6 g of potassium bromide with distilled water to a volume of 200 ml. To the aforementioned mixture maintained at 39° C. and stirred in a titanium-coated stainless steel reaction vessel, the whole volume of Solution A was added by the controlled double jet method over 1 minute at a constant flow rate while pAg was maintained at 8.1. Solution B was also added by the controlled double jet method. Then, the mixture was added with 30 ml of 3.5% by weight aqueous hydrogen peroxide solution, and further added with 36 ml of a 3% by weight aqueous solution of benzimidazole. Separately, Solution A2 was prepared by diluting Solution A with distilled water to a volume of 317.5 ml, and Solution B2 was prepared by dissolving tripotassium hexachloroiridate in Solution B in such an amount that its final concentration should become $1\times10^{-4}$ mole per mole of silver, and diluting the obtained solution with distilled water to a volume twice as much as the volume of Solution B, 400 ml. The whole volume of Solution A2 was added to the mixture again by the controlled double jet method over 10 minutes at a constant flow rate while pAg was maintained at 8.1. Solution B2 was also added by the controlled double jet method. Then, the mixture was added with 50 ml of a 0.5% by weight solution of 2-mercapto-5-methylbenzimidazole in methanol. After pAg was raised to 7.5 with silver nitrate, the mixture was adjusted to pH 3.8 using 0.5mol/L sulfuric acid, and the stirring was stopped. Then, the mixture was subjected to precipitation, desalting and washing with water, added with 3.5 g of deionized gelatin and 1 N sodium hydroxide to be adjusted to pH 6.0 and pAg of 8.2 to form a silver halide dispersion.

The grains in the completed silver halide emulsion were pure silver bromide cubic grains (with slightly rounded corners) having a mean spherical diameter of 0.06 μm and a variation coefficient of 18% in terms of spherical diameter. The grain size and others were obtained from averages for 1000 grains by using an electron microscope. The [100] face ratio of these grains were determined to be 85% by the Kubelka-Munk method.

The aforementioned emulsion was added with 0.035 g of benzoisothiazolinone (added as a 3.5% by weight methanol solution of the compound) with stirring at 38° C., and after 40 minutes since then, added with the solid dispersion (an aqueous gelatin solution) of Spectral sensitizing dye A in an amount of $5\times10^{-3}$ mole per mole of silver. After 1 minutes, the mixture was warmed to 47° C., and after 20 minutes, added with $3\times10^{-5}$ mole of sodium benzenethiosulfonate per mole of silver. Further after 2 minutes, the mixture was added with Tellurium sensitizer B in an amount of $5\times10^{-5}$ mole per mole of silver followed by ripening for 90 minutes. Immediately before finishing the ripening, the mixture was added with 5 ml of a 0.5% by weight methanol solution of N,N'-dihydroxy-N"-diethylmelamine, and after the temperature was lowered to 31° C., the mixture was added with 5 ml of a 3.5% by weight methanol solution of phenoxyethanol, $7\times10^{-3}$ mole of 5-methyl-2-mercaptobenzimidazole per mole of silver, and $6.4\times10^{-3}$ mole of 1-phenyl-2-heptyl-5-mercapto-1,3,4-triazole per mole of silver to prepare Silver halide emulsion 1.

(Preparation of Silver Halide Emulsion 2)

In the same manner as the preparation of Silver halide emulsion 1 except that the liquid temperature upon forming the grains was changed from 39° C. to 47° C., a pure silver bromide cubic grain emulsion having a mean grain size of 0.08 μm as spheres and a variation coefficient of 15% for size as spheres was prepared. Further, in the same manner as the preparation of Silver halide emulsion 1, the steps of precipitation, desalting, washing with water and dispersion were performed. Furthermore, in the same manner as the preparation of Silver halide emulsion 1 except that the addition amount of Spectral sensitizing dye A was changed to $4.5\times10^{-3}$ mole per mole of silver, the spectral sensitizer, the chemical sensitizer, 5-methyl-2-mercaptobenzimidazole and 1-phenyl-2-heptyl-5-mercapto-1,3,4-traizole were added to the emulsion to obtain Silver halide emulsion 2.

(Preparation of Silver Halide Emulsion 3)

In the same manner as the preparation of Silver halide emulsion 1 except that the liquid temperature upon forming the grains was changed from 39° C. to 25° C., a pure silver bromide cubic grain emulsion having a mean grain size of 0.03 μm as spheres and a variation coefficient of 15% for size as spheres was prepared. Further, in the same manner as the preparation of Silver halide emulsion 1, the steps of precipitation, desalting, washing with water and dispersion were performed. Furthermore, in the same manner as the preparation of Silver halide emulsion 1 except that the addition amount of Spectral sensitizing dye A was changed to $7\times10^{-3}$ mole per mole of silver, the spectral sensitizer, the chemical sensitizer, 5-methyl-2-mercaptobenzimidazole and 1-phenyl-2-heptyl-5-mercapto-1,3,4-traizole were added to the emulsion to obtain Silver halide emulsion 3.

(Preparation of Silver Halide Emulsion 4)

In the same manner as the preparation of Silver halide emulsion 1 except that the liquid temperature upon forming the grains was changed from 39° C. to 32° C., a pure silver bromide cubic grain dispersion having a mean grain size of 0.045 μm as spheres and a variation coefficient of 15% for size as spheres was prepared. Further, in the same manner as the preparation of Silver halide emulsion 1, the steps of precipitation, desalting, washing with water and dispersion were performed. Furthermore, in the same manner as the preparation of Silver halide emulsion 1 except that the addition amount of Spectral sensitizing dye A was changed to $6\times10^{-3}$ mole per mole of silver, the spectral sensitizer, the chemical sensitizer, 5-methyl-2-mercaptobenzimidazole and 1-phenyl-2-heptyl-5-mercapto-1,3,4-traizole were added to the emulsion to obtain Silver halide emulsion 4.

(Preparation of Mixed Emulsion A for Coating Solution)

Emulsion A for coating solution was prepared by using each of the aforementioned Silver halide emulsions 1 to 4. The mixing ratio of each silver halide emulsion is shown in Table 1. To each Emulsion A, benzothiazolium iodide in an amount of $7\times10^{-3}$ mole per mole of silver was added as a 1% by weight aqueous solution.

(Preparation of Scaly Fatty Acid Silver Salt)

87.6 g of behenic acid (Edenor C22-85R, trade name, manufactured by Henkel Co.), 423 ml of distilled water, 49.2 ml of a 5 N aqueous solution of NaOH, and 120 ml of tert-butanol were mixed and reacted with stirring at 75° C. for one hour to obtain a solution of sodium behenate. Separately, 206.2 ml of an aqueous solution containing 40.4 g of silver nitrate (pH 4.0) was prepared and kept at 10° C. A mixture of 635 ml of distilled water and 30 ml of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. The mixtures were added in such a manner that only the aqueous silver nitrate solution was added for 7 minutes and 20 seconds after starting the addition of the aqueous silver nitrate solution, and for 9 minutes and 30 seconds after finishing the addition of the aqueous silver nitrate solution, only the sodium behenate solution was added. The outside temperature was controlled so that the temperature in the reaction vessel was kept at 30° C. and the liquid temperature was constant. The piping of the addition system for the sodium behenate solution was warmed by steam trace and the steam opening was controlled such that the liquid temperature at the outlet orifice of the addition nozzle was 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled at heights for not contacting with the reaction mixture.

After the addition of the sodium behenate solution was completed, the mixture was left with stirring for 20 minutes at the same temperature and then the temperature was decreased to 25° C. Then the solid content was recovered by a suction filtration and the solid content was washed with water until electric conductivity of the filtrate became 30 μS/cm. Thus, a fatty acid silver salt was obtained. The solid content was stored as a wet cake without being dried.

When the shape of the obtained silver behenate grains was evaluated by an electron microscopic photography, the grains were scaly crystals having a=0.14 μm b=0.4 μm, and c=0.6 μm in mean values, a mean aspect ratio of 5.2, a mean diameter as spheres of 0.52 μm, and a variation coefficient of 15% for mean diameter as spheres (a, b and c have the meanings defined in the present specification).

To the wet cake corresponding to 100 g of the dry solid content was added with 7.4 g of polyvinyl alcohol (PVA-217, trade name) and water to make the total amount 385 g, and the mixture was pre-dispersed by a homomixer.

Then, the pre-dispersed stock dispersion was treated three times by using a dispersing machine (Microfluidizer-M-11OS-EH; trade name, manufactured by Microfluidex International Corporation, using G10Z interaction chamber) with a pressure controlled to be 1750 kg/cm$^2$ to obtain a silver behenate dispersion. During the cooling operation, a dispersion temperature of 18° C. was achieved by providing coiled heat exchangers fixed before and after the interaction chamber and controlling the temperature of the refrigerant.

(Preparation of 25% by Weight Dispersion of Reducing Agent)

10 kg of 1,1-bis(2-hydroxy-3,5-dimethylphenyl)-3,5,5-trimethylhexane and 10 kg of a 20% by weight aqueous solution of denatured polyvinyl alcohol (Poval MP203, manufactured by KURARAY CO., LTD.) were added with 16 kg of water, and mixed sufficiently to form a slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent should become 25% by weight to obtain a reducing agent dispersion. The reducing agent particles contained in the reducing agent dispersion obtained as described above had a median diameter of 0.42 μm and the maximum particle size of 2.0 μm or shorter. The obtained reducing agent dispersion was filtered through a polypropylene filter having a pore size of 10.0 μm to remove dusts and so forth, and stored.

(Preparation of 25% by Weight Dispersion of Compound Represented by the Formula (1))

100 g of a compound represented by the formula (1), 100 g of a 20% by weight aqueous solution of denatured polyvinyl alcohol (Poval MP203, manufactured by KURARAY CO., LTD.), 4.5 g of a 20% by weight aqueous solution of sodium triisopropylnaphthalenesulfonate and 195.5 g of water were mixed sufficiently to form a slurry. The slurry was fed into a 1/4G vessel together with 960 g of zirconia silicate beads having a mean particle diameter of 0.5 mm and dispersed for 5 hours by a sand grinder mill (manufactured by Imex Co.). Then, the slurry was added with sodium salt of benzisothiazolinone at a concentration of 100 ppm to obtain a solid microparticle dispersion. The particles contained in the solid microparticle dispersion obtained as described above had a median diameter of 0.35 to 0.45 μm and the maximum particle size of 2.0 μm or shorter. The obtained dispersion was filtered through a polypropylene filter having a pore size of 3.0 μm to remove dusts and so forth, and stored.

(Preparation of 5% by Weight Solution of Phthalazine Compound)

8 kg of denatured polyvinyl alcohol (Poval MP-203, manufactured by KURARAY CO., LTD.) was dissolved in 174.57 kg of water and then added with 3.15 kg of 20% by weight aqueous solution of sodium triisopropylnaphthalenesulfonate and 14.28 kg of 70% by weight of 6-isopropylphthalazine was added to obtain a 5% by weight solution of 6-isopropylphthalazine.

(Preparation of 20% by Weight Dispersion of Pigment)

64 g of C.I. Pigment Blue 60 and 6.4 g of Demor N manufactured by Kao Corporation were added with 250 g of water and mixed sufficiently to provide a slurry. Then, 800 g of zirconia beads having a mean diameter of 0.5 mm were placed in a vessel together with the slurry and the slurry was dispersed by a dispersing machine (1/4G Sand Grinder Mill; manufactured by Imex Co.) for 25 hours to obtain a pigment dispersion. The pigment particles contained in the pigment dispersion obtained as described above had a mean particle size of 0.21 μm.

(Preparation of 40% by Weight SBR Latex)

An SBR latex purified by ultrafiltration (UF) was obtained as follows.

The SBR latex mentioned below diluted by 10 times with distilled water was diluted and purified by using an UF-purification module FS03-FC-FUY$O_3$A1 (manufactured by Daisen Membrane System K.K.) until the ion conductivity became 1.5 mS/cm, and added with Sandet-BL (manufactured by SANYO CHEMICAL INDUSTRIES, LTD.) to a concentration of 0.22% by weight. Further, the latex was added with NaOH and $NH_4OH$ so that the ratio $Na^+$ ion:$NH_4^+$ ion should become 1:2.3 (molar ratio) to adjust pH to 8.4. At this point, the concentration of the latex was 40% by weight.

[SBR latex: A Latex of—St(68)-Bu(29)-AA(3)]

The latex had the following characteristics: mean particle size of 0.1 μm, concentration of 45%, equilibrated moisture content of 0.6% by weight at 25° C., relative humidity 60%, ion conductivity of 4.2 mS/cm (measured for the latex stock solution (40%) at 25° C. by using a conductometer, CM-30S, manufactured by Toa Electronics, Ltd.), and pH of 8.2.

(Preparation of Coating Solution for Emulsion Layer (Image-forming Layer))

1.1 g of the 20% by weight aqueous dispersion of the pigment obtained above, 103 g of the organic acid silver salt dispersion, 5 g of the 20% by weight aqueous solution of polyvinyl alcohol, PVA-205 (manufactured by KURARAY CO. LTD.), 25 g of the 25% by weight dispersion of the reducing agent, a compound of the formula (1) (type and amount thereof are shown in Table 1 (mol/mol-Agβ used in Table 1 for indicating the addition amount means the added molar number per mole of silver in total of the silver halide and the silver salt of an organic acid), 106 g of the 40% by weight SBR latex purified by ultrafiltration (UF) and undergone pH adjustment, and 18 ml of the 5% by weight solution of the phthalazine compound were combined, added with 10 g of Silver halide emulsion A, and mixed sufficiently to prepare a coating solution for an emulsion layer. The coating solution was fed as it was to a coating die in such a feeding amount giving a coating amount of 70 ml/$m^2$ and coated.

The viscosity of the coating solution for emulsion layer described above was measured by a B-type viscometer manufactured by Tokyo Keiki K.K. and found to be 85 [mPa·s] at 40° C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [1/second], respectively.

(Preparation of Coating Solution for Intermediate Layer on the Emulsion Layer Surface)

772 g of an aqueous solution of 10% by weight polyvinyl alcohol, PVA-205 (manufactured by KURARAY CO., LTD.), 5.3 g of the 20% by weight dispersion of the pigment, and 226 g of a 27.5% by weight latex of methyl methacrylate/styrene/butyl acrylate/hydroxyethyl methacrylate/acrylic acid copolymer (copolymerization ratio (by weight): 64/9/20/5/2) were added with 2 ml of a 5% by weight aqueous solution of Aerosol OT (manufactured by American Cyanamid Company), 10.5 ml of a 20% by weight aqueous solution of phthalic acid diammonium salt and water in such an amount giving a total amount of 880 g to form a coating solution for intermediate layer. This coating solution was fed to a coating die in such an amount that gave a coating amount of 10 ml/$m^2$. The viscosity of the coating solution measured by a B-type viscometer at 40° C. (Rotor No. 1, 60 rpm) was 21 [mPa·s].

(Preparation of Coating Solution for 1st Protective Layer on Emulsion Layer Surface)

64 g of inert gelatin was dissolved in water, added with 80 g of a 27.5% by weight latex solution of methyl methacrylate/styrene/butyl acrylate/hydroxyethyl methacrylate/acrylic acid copolymer (copolymerization ratio (by weight): 64/9/20/5/2), 23 ml of a 10% by weight methanol solution of phthalic acid, 23 ml of a 10% by weight aqueous solution of 4-methylphthalic acid, 28 ml of 1 N sulfuric acid, 5 ml of a 5% by weight aqueous solution of Aerosol OT (manufactured by American Cyanamid Company), 0.5 g of phenoxyethanol, 0.1 g of benzoisothiazolinone, and water in such an amount that gave a total amount of 750 g to form a coating solution. The coating solution was mixed with 26 ml of 4% by weight chromium alum by a static mixer immediately before coating, and fed to a coating die in such an amount that gave a coating amount of 18.6 ml/$m^2$. The viscosity of the coating solution measured by a B-type viscometer (Rotor No. 1, 60 rpm) at 40° C. was 17 [mPa·s].

(Preparation of Coating Solution for 2nd Protective Layer on Emulsion Layer Surface)

80 g of inert gelatin was dissolved in water, added with 102 g of a 27.5% by weight latex solution of methyl methacrylate/styrene/butyl acrylate/hydroxyethyl methacrylate/acrylic acid copolymer (copolymerization ratio (by weight): 64/9/20/5/2), 3.2 ml of a 5% by weight solution of N-perfluorooctylsulfonyl-N-propylalanine potassium salt, 32 ml of a 2% by weight aqueous solution of polyethylene glycol mono(N-perfluorooctylsulfonyl-N-propyl-2-aminoethyl) ether [average polymerization degree of ethylene oxide=15], 23 ml of a 5% by weight aqueous solution of Aerosol OT (manufactured by American Cyanamid Company), 4 g of polymethyl methacrylate microparticles (mean particle size: 0.7 μm), 21 g of polymethyl methacrylate microparticles (mean particle size: 6.4 μm), 1.6 g of 4-methylphthalic acid, 4.8 g of phthalic acid, 44 ml of 1 N sulfuric acid, 10 mg of benzoisothiazolinone and water in such an amount that gave a total amount of 650 g. The mixture was further mixed with 445 ml of an aqueous solution containing 4% by weight chromium alum and 0.67% by weight of phthalic acid by a static mixer immediately before coating to form a coating solution for surface protective layer, which was fed to a coating die in such an amount that gave a coating amount of 8.3 ml/$m^2$. The viscosity of the coating solution measured by a B-type viscometer (Rotor No. 1, 60 rpm) at 40° C. was 9 [mPa·s].

(Preparation of Photothermographic Material)

On the back side of the aforementioned support having an undercoat layer, the coating solution for antihalation layer and the coating solution for back surface protective layer were simultaneously applied as stacked layers so that the applied solid content amount of the solid microparticle dye in the antihalation layer should be 0.04 g/$m^2$, and the applied amount of gelatin in the protective layer should be 1.7 g/$m^2$, and dried to form an antihalation back layer.

Then, on the side opposite to the back side, an emulsion layer (coated silver amount of the silver halide was 0.14 g/$m^2$), intermediate layer, first protective layer, and second protective layer were simultaneously applied in this order from the undercoat layer by the slide bead application method as stacked layers to form a sample of photothermographic material.

The coating was performed at a speed of 160 m/min. The gap between the tip of coating die and the support was set to be 0.14 to 0.28 mm, and the coated width was controlled so that it spread by each 0.5 mm at both sides compared with the projecting slit width of the coating solution. The pressure in the reduced pressure chamber was adjusted to be lower than the atmospheric pressure by 392 Pa. In the above operation, handling, temperature and humidity were controlled so that the support should not be electrostatically charged and electrostatic charge was further eliminated by ionized wind immediately before the coating. In the subsequent chilling zone, the material was blown with air showing a dry-bulb temperature of 18° C. and a wet-bulb temperature of 12° C. for 30 seconds to cool the coating solutions. Then, in the floating type drying zone in a coiled shape, the material was blown with drying air showing a dry-bulb temperature of 30° C. and a wet-bulb temperature of 18° C. for 200 seconds. Subsequently, the material was passed through a drying zone of 70° C. for 20 seconds, and then another drying zone of 90° C. for 10 seconds, and cooled to 25° C. to evaporate the solvent in the coating solution. The average wind velocities of the wind applied to the coated layer surface in the chilling zone and the drying zones were 7 m/sec.

Spectral Sensitizing Dye A

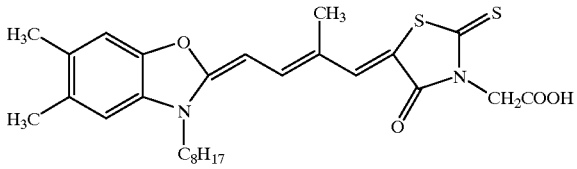

Tellurium Sensitizer B

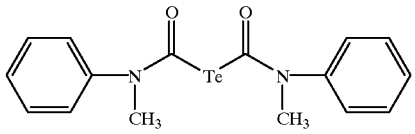

Base Precursor Compound 11

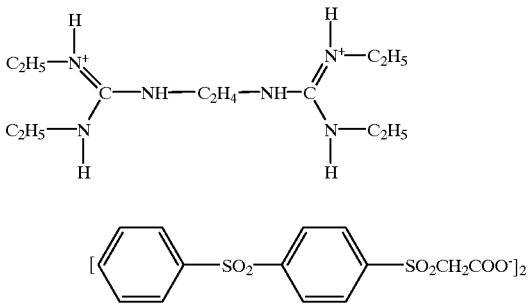

Cyanine Dye Compound 13

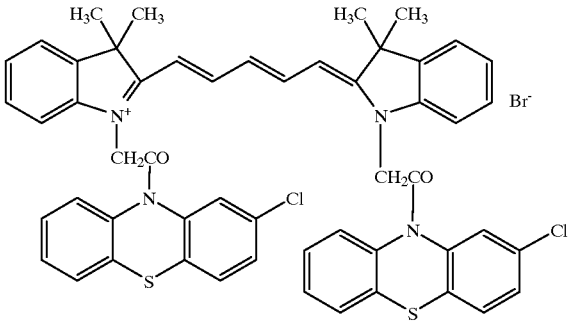

Blue Dye Compound 14

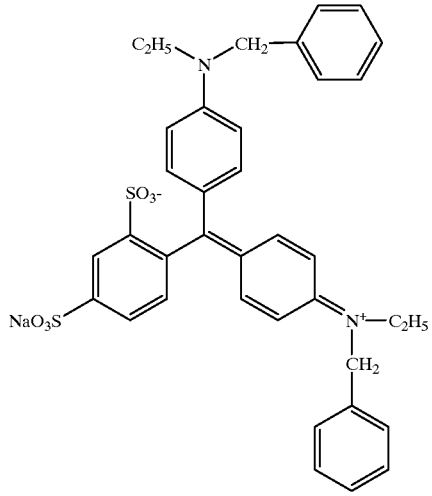

(Evaluation of Photographic Performance)

Each photothermographic material was light-exposed and heat-developed (at about 120° C.) by using Fuji Medical Dry Laser Imager FM-DPL (equipped with a semiconductor laser of 660 nm and a maximum output of 60 mW (IIIB)), and the obtained image was evaluated by a densitometer.

Sensitivity was evaluated as a reciprocal of a ratio of exposure amounts giving a density higher than the fogging (Dmin) by 1.0, and expressed as a relative value based on the value obtained for a fresh sample of the photothermographic material of Experiment No. 1 (defined as 100). As a practical level, a sensitivity of 95 to 105 is required.

(Evaluation of Storability of Photothermographic Material Before Development)

Each photothermographic material was conditioned for humidity at 25° C. and a humidity of 30% RH, and cut into sheets. Three sets of three sheets stacked and put into moisture-proof bags were prepared for each sample and stored (1) at 60° C. for 7 hours or (2) at 40° C. for 3 days. Then, a sheet before the storage and a middle sheet of the stacked three sheets (second sheet) were light-exposed and heat-developed as described above to evaluate the photographic performance (the storage condition (1) of 60° C. for 7 hours simulated a midsummer and daytime condition in an automobile).

The results are shown in Tables 1 and 2. In the tables, the numbers of the compounds represented by the formula (1) correspond to the numbers of those compounds of which structures were mentioned hereinabove as preferred compounds. Structures of the other organic polyhalogenated compounds are shown below. The organic polyhalogenated compounds were dispersed in the same manner as that used for the compounds represented by the formula (1), except for Organic polyhalogenated compound 4, which was added after neutralization with an equimolar amount of aqueous sodium hydroxide. It was demonstrated that the photothermographic materials of the present invention had high sensitivity and superior storability before development.

TABLE 1

| Ex. No. | Mixing ratio of silver halide (%) (mean grain size) Emulsion 1 (0.06 μm) | Emulsion 2 (0.08 μm) | Emulsion 3 (0.03 μm) | Emulsion 4 (0.045 μm) | Compound of formula (1) Type | Addition amount (mol/mol-Ag β) | Organic polyhalogenated compound Type | Addition amount (mol/mol-Ag β) |
|---|---|---|---|---|---|---|---|---|
| 1 | 100 | — | — | — | P-24 | $0.7 \times 10^{-1}$ | Organic polyhalogenated compound 1 | $0.6 \times 10^{-1}$ |
| 2 | — | 100 | — | — | P-24 | $0.7 \times 10^{-1}$ | Organic polyhalogenated compound 1 | $0.6 \times 10^{-1}$ |
| 3 | — | — | 100 | — | P-24 | $0.7 \times 10^{-1}$ | Organic polyhalogenated compound 1 | $0.6 \times 10^{-1}$ |
| 4 | — | — | — | 100 | P-24 | $0.7 \times 10^{-1}$ | Organic polyhalogenated compound 1 | $0.6 \times 10^{-1}$ |
| 5 | — | 100 | — | — | Organic polyhalogenated compound 1 | $1.3 \times 10^{-1}$ | — | — |
| 6 | 100 | — | — | — | Organic polyhalogenated compound 1 | $1.3 \times 10^{-1}$ | — | — |
| 7 | — | — | 100 | — | Organic polyhalogenated compound 1 | $1.3 \times 10^{-1}$ | — | — |
| 8 | 100 | — | — | — | Organic polyhalogenated compound 2 | $0.7 \times 10^{-1}$ | Organic polyhalogenated compound 1 | $0.6 \times 10^{-1}$ |
| 9 | 50 | — | 50 | — | P-24 | $0.7 \times 10^{-1}$ | Organic polyhalogenated compound 1 | $0.6 \times 10^{-1}$ |
| 10 | — | — | — | 100 | P-80 | $0.7 \times 10^{-1}$ | Organic polyhalogenated compound 1 | $0.6 \times 10^{-1}$ |
| 11 | — | — | — | 100 | P-109 | $0.7 \times 10^{-1}$ | Organic polyhalogenated compound 1 | $0.6 \times 10^{-1}$ |
| 12 | — | — | — | 100 | P-51 | $0.7 \times 10^{-1}$ | Organic polyhalogenated compound 1 | $0.6 \times 10^{-1}$ |
| 13 | — | — | — | 100 | P-64 | $0.7 \times 10^{-1}$ | Organic polyhalogenated compound 1 | $0.6 \times 10^{-1}$ |
| 14 | — | — | — | 100 | P-24 | $1.3 \times 10^{-1}$ | — | — |
| 15 | — | — | — | 100 | P-24 | $0.7 \times 10^{-1}$ | Organic polyhalogenated compound 2 | $0.6 \times 10^{-1}$ |
| 16 | — | — | — | 100 | P-24 | $0.7 \times 10^{-1}$ | Organic polyhalogenated compound 3 | $0.6 \times 10^{-1}$ |
| 17 | — | — | — | 100 | P-24 | $1.2 \times 10^{-1}$ | Organic polyhalogenated compound 4 | $0.1 \times 10^{-1}$ |
| 18 | — | — | — | 100 | P-24 | $0.7 \times 10^{-1}$ | P-64 | $0.6 \times 10^{-1}$ |

TABLE 2

| Ex. | Fresh photographic property | | | Storability before development-1 (stored at 40° C. for 3 days) | | | Storability before development-2 (stored at 60° C. for 7 hours) | | | |
|---|---|---|---|---|---|---|---|---|---|---|
| No. | Dmin | Sensitivity | Dmax | Dmin | Sensitivity | Dmax | Dmax | Sensitivity | Dmax | Note |
| 1 | 0.15 | 100 | 3.4 | 0.15 | 100 | 3.4 | 0.15 | 99 | 3.4 | Invention |
| 2 | 0.15 | 93 | 3.4 | 0.15 | 93 | 3.4 | 0.15 | 91 | 3.4 | Comparative Exarnple |
| 3 | 0.15 | 104 | 3.4 | 0.15 | 104 | 3.4 | 0.16 | 103 | 3.3 | Invention |
| 4 | 0.15 | 102 | 3.4 | 0.15 | 102 | 3.4 | 0.15 | 101 | 3.3 | Invention |
| 5 | 0.15 | 93 | 3.4 | 0.15 | 92 | 3.3 | 0.16 | 90 | 3.2 | Comparative Example |
| 6 | 0.15 | 102 | 3.4 | 0.15 | 95 | 3.2 | 0.15 | 80 | 2.9 | Comparative Example |
| 7 | 0.15 | 105 | 3.4 | 0.15 | 88 | 2.9 | 0.16 | 65 | 2.7 | Comparative Example |
| 8 | 0.15 | 103 | 3.4 | 0.15 | 96 | 3.2 | 0.15 | 82 | 2.9 | Comparative Example |
| 9 | 0.15 | 102 | 3.4 | 0.15 | 102 | 3.4 | 0.15 | 102 | 3.4 | Invention |
| 10 | 0.15 | 102 | 3.4 | 0.15 | 102 | 3.4 | 0.15 | 101 | 3.3 | Invention |
| 11 | 0.15 | 101 | 3.4 | 0.15 | 101 | 3.4 | 0.15 | 100 | 3.3 | Invention |
| 12 | 0.15 | 101 | 3.4 | 0.15 | 101 | 3.4 | 0.15 | 100 | 3.3 | Invention |
| 13 | 0.15 | 102 | 3.4 | 0.15 | 102 | 3.4 | 0.15 | 101 | 3.3 | Invention |
| 14 | 0.15 | 101 | 3.4 | 0.23 | 103 | 3.4 | 0.23 | 102 | 3.3 | Comparative Example |
| 15 | 0.15 | 100 | 3.4 | 0.15 | 100 | 3.4 | 0.15 | 102 | 3.4 | Invention |
| 16 | 0.15 | 99 | 3.4 | 0.15 | 100 | 3.4 | 0.15 | 102 | 3.4 | Invention |
| 17 | 0.15 | 99 | 3.4 | 0.15 | 99 | 3.4 | 0.15 | 99 | 3.4 | Invention |
| 18 | 0.15 | 100 | 3.4 | 0.15 | 101 | 3.4 | 0.15 | 101 | 3.4 | Invention |

Organic Polyhalogenated Compound-1

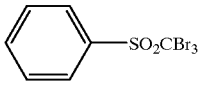

Organic Polyhalogenated Compound-2

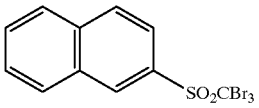

Organic Polyhalogenated Compound-3

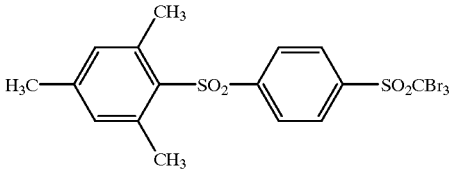

Organic Polyhalogenated Compound-4

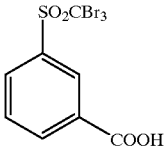

Example 2

Two kinds of photothermographic materials were prepared according to the production process described in JP-A-11-174621 and used for Sample No. 205 mentioned in Example 2 of the same, by using the aforementioned Heteroaromatic mercapto compound (A) instead of Compound A, or by using the aforementioned Compound P-24 or the aforementioned solid microparticle dispersion of Comparative Compound 1 instead of tribromomethylphenylsulfone. The addition amount of Heteroaromatic mercapto compound (A) and the addition amount of Compound P-24 or Comparative Compound 1 were similar to those of the samples of Experiments Nos. 1 and 4 in Table 1, respectively. When they were evaluated for photographic performance and storability in the same manner as in Example 1, the sample utilizing Compound P-24 showed more preferred results compared with the sample utilizing Comparative Compound 1 like the results shown in Table 1.

Example 3

Two kinds of photothermographic materials were prepared according to the production process for Level 2 described in Example 1 of JP-A-11-195011 by using the aforementioned Heteroaromatic mercapto compound (A) instead of Compound B, or by using the aforementioned Compound P-24 or the aforementioned Comparative Compound 1 instead of Compound I-39. The addition amount of Heteroaromatic mercapto compound (A) and the addition amount of Compound P-24 or Comparative Compound 1 were similar to those of the samples of Experiments Nos. 1 and 4 in Table 1, respectively. When they were evaluated for photographic performance and storability in the same manner as in Example 1, the sample utilizing Compound P-24 showed more preferred results compared with the sample utilizing Comparative Compound 1 like the results shown in Table 1.

What is claimed is:

1. A photothermographic material comprising, on one side of a support, at least one photosensitive silver halide, a non-photosensitive silver salt of an organic acid, a reducing agent for silver ions and a binder, wherein the photosensitive silver halide has a mean grain size of 0.001 $\mu$m to 0.06 $\mu$m and the material comprises at least two organic polyhalogenated compounds at least one of which is an organic polyhalogenated compound represented by the following formula (1):

Formula (1)

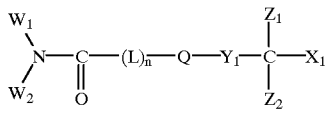

wherein $Z_1$ and $Z_2$ independently represent a halogen atom, $X_1$ represents a hydrogen atom or an electron withdrawing group, $Y_1$ represents —CO— group or -$SO_2$— group, Q represents an arylene group or a divalent heterocyclic group, L represents a bridging group, $W_1$ and $W_2$ independently represent a hydrogen atom, an alkyl group, an aryl group or a heterocyclic group, and n represents 0 or 1.

2. The photothermographic material according to claim 1, wherein both of $Z_1$ and $Z_2$ are bromine atoms.

3. The photothermographic material according to claim 1, wherein both of $Z_1$ and $Z_2$ are bromine atoms and $X_1$ is hydrogen atom or a halogen atom.

4. The photothermographic material according to claim 3, wherein $X_1$ is bromine atom.

5. The photothermographic material according to claim 3, wherein $Y_1$ is —$SO_2$— group.

6. The photothermographic material according to claim 4, wherein $Y_1$ is —$SO_2$— group.

7. The photothermographic material according to claim 5, wherein Q is a phenylene group.

8. The photothermographic material according to claim 6, wherein Q is meta-phenylene group.

9. The photothermographic material according to claim 8, wherein L is a group selected from the group consisting of an alkylene group, an arylene group, —O— group, —N(R)CO— group, —$SO_2$—N(R)— group or a group composed of a combination thereof wherein R is a hydrogen atom, an alkyl group which may be substituted, or an aryl group which may be substituted.

10. The photothermographic material according to claim 9, wherein n is 0.

11. The photothermographic material according to claim 10, wherein $W_1$ and $W_2$ independently are a group selected from the group consisting of a hydrogen atom, an alkyl group, and an aryl group.

12. The photothermographic material according to claim 1, wherein a layer containing the organic polyhalogenated compound represented by the formula (1) is formed by using an aqueous coating solution and the organic polyhalogenated compound represented by the formula (1) is added to the aqueous coating solution as an aqueous dispersion.

13. The photothermographic material according to claim 1, wherein the amount (total amount) of the organic polyhalogenated compounds is $1\times10^{-6}$ to 1 mole per mole of silver.

14. The photothermographic material according to claim 1, wherein the combination ratio of the polyhalogenated compound other than the polyhalogenated compound represented by the formula (1) and the polyhalogenated compound represented by the formula (1) is in the range of 0.01:99.99 to 99.99:0.01.

15. The photothermographic material according to claim 1, wherein the amount of the photosensitive silver halide is preferably 0.03 to 0.6 $g/m^2$.

* * * * *

UNITED STATES PATENT AND TRADEMARK OFFICE

CERTIFICATE OF CORRECTION

PATENT NO. : 6,368,782 B1
DATED : April 9, 2002
INVENTOR(S) : Kouta Fukui et al.

It is certified that error appears in the above-identified patent and that said Letters Patent is hereby corrected as shown below:

Title page,
Item [*] Notice, replace "Subject to any disclaimer, the term of this patent is extended or adjusted under 35 U.S.C. 154(b) by 0 days." with
-- Subject to any disclaimer, the term of this patent is extended or adjusted under 35 U.S.C. 154(b) by 9 days. --

Signed and Sealed this

Tenth Day of February, 2004

JON W. DUDAS
*Acting Director of the United States Patent and Trademark Office*